US006924824B2

(12) United States Patent
Adachi et al.

(10) Patent No.: US 6,924,824 B2
(45) Date of Patent: Aug. 2, 2005

(54) ACTIVE MATRIX DISPLAY DEVICE AND METHOD OF DRIVING THE SAME

(75) Inventors: Katsumi Adachi, Kashiba (JP); Makoto Yamakura, Moriguchi (JP); Kunio Sekimoto, Katano (JP); Yoshinori Kobayashi, Neyagawa (JP)

(73) Assignee: Matsushita Electric Industrial Co., Ltd. (JP)

( * ) Notice: Subject to any disclaimer, the term of this patent is extended or adjusted under 35 U.S.C. 154(b) by 651 days.

(21) Appl. No.: 09/936,172

(22) PCT Filed: Jan. 15, 2001

(86) PCT No.: PCT/JP01/00182

§ 371 (c)(1),
(2), (4) Date: Sep. 10, 2001

(87) PCT Pub. No.: WO01/52229

PCT Pub. Date: Jul. 19, 2001

(65) Prior Publication Data

US 2003/0058195 A1 Mar. 27, 2003

(30) Foreign Application Priority Data

Jan. 14, 2000 (JP) ..... 2000-005503
Mar. 31, 2000 (JP) ..... 2000-097305
Sep. 29, 2000 (JP) ..... 2000-300063

(51) Int. Cl.[7] ..... G09G 3/28

(52) U.S. Cl. ..... 345/690; 345/80; 345/89; 345/691; 345/76; 315/169.3

(58) Field of Search ..... 345/67, 80, 82, 345/89, 76, 205, 206, 691, 92, 100, 99; 315/169.3; 313/500; 349/17, 33, 69; 359/242

(56) References Cited

U.S. PATENT DOCUMENTS 5,252,959 A 10/1993 Kono ..... 345/147
5,414,442 A 5/1995 Yamazaki et al. ..... 345/89
5,644,329 A * 7/1997 Asari et al. ..... 345/89
5,990,629 A 11/1999 Yamada et al. ..... 315/169.3
6,100,939 A 8/2000 Kougami et al. ..... 348/687
6,157,356 A * 12/2000 Troutman ..... 345/82
6,229,515 B1 5/2001 Itoh et al. ..... 345/103
6,570,550 B1 * 5/2003 Handschy et al. ..... 345/89

FOREIGN PATENT DOCUMENTS

| | | |
|---|---|---|
| EP | 0 319 291 | 12/1988 |
| GB | 2 327 798 | 2/1999 |
| GB | 2 336 459 | 10/1999 |
| JP | 03-035218 | 2/1991 |
| JP | 06222330 | 8/1994 |
| JP | 07-168159 | 7/1995 |
| JP | 09006287 | 1/1997 |
| JP | 09-83911 | 3/1997 |
| JP | 11-38928 | 2/1999 |
| JP | 11-296131 | 10/1999 |
| JP | 11-327491 | 11/1999 |
| JP | 2001-083943 | 3/2001 |

* cited by examiner

*Primary Examiner*—Xiao Wu
*Assistant Examiner*—Abbas I Abdulselam
(74) *Attorney, Agent, or Firm*—Parkhurst & Wendel, L.L.P.

(57) ABSTRACT

The present invention provides a method of driving an active matrix display device in which one frame comprises a plurality of sub-frames each comprising a write time and a hold time and gray scale driving is brought about by the cumulative effect of the hold times. Gray scale display driving is carried out by randomly scanning scan lines other than one predetermined scan line in a predetermined sequence in the hold time of each sub-frame corresponding to the one predetermined scan line so that any one sub-frame is not written to any one scan line more than once and one frame is such that in each of the scan lines, the writings and the hold time of each of the sub-frames is ensured to bring about gray scale display. Through this means, the frame period is shortened.

66 Claims, 18 Drawing Sheets

ACTIVE MATRIX DISPLAY DEVICE AND METHOD OF DRIVING THE SAME

TECHNICAL FIELD

The present invention relates to active matrix-type display devices, in particular to display devices using liquid crystal or organic EL (electroluminescence) and to driving methods of the same. More specifically, the present invention relates to display devices that bring about multiple-level gray scale display by combining two or multiple values of voltage levels in temporally weighted sub-frame periods and to driving methods of the same.

BACKGROUND ART

There has been a need for display devices that consume even less power for use in battery operated, compact, portable devices. As typical display devices that meet such a need, liquid crystal and organic EL (electroluminescent) display devices are known in the art. Active matrix-type display devices using these display elements, display devices that typically use three-terminal thin film transistors (TFTs) as the switching elements, usually bring about gray scale display by controlling the brightness of the pixels with analog voltage or current. For example, in the case of a liquid crystal display device by the application of analog voltage and in the case of organic EL display device by the flow of analog current, the brightness of the display elements is varied, bringing about gray scale display.

FIG. 10 shows the construction of a prior art active matrix liquid crystal panel. A method of bringing about gray scale display in this panel is described later. Reference numeral 101 denotes an active matrix-type liquid crystal panel comprising signal lines S1 to Sn, scan lines G1 to Gm intersecting the signal lines, and switching elements located in the vicinity of the intersection points. Si denotes any given signal line, Gj any given scan line, and reference numeral 102 a switching element in the vicinity of the intersection point of these lines, the switching element in this case being an example of a commonly used three-terminal thin film transistor (TFT). Reference numeral 103 denotes a liquid crystal element. A counter electrode Vcom is formed on the side confronting a transistor 102. Reference numeral 104 denotes a storage capacitor for helping to sustain the capacitance component of the liquid crystal element 103 to prevent image degradation. It is usual for an additional electrode Vst on the other side of the storage capacitor to be commonly connected to the counter electrode Vcom. An intersection point 105 on the transistor side corresponds to a pixel electrode.

To explain operation of the device simply, the scan line Gj reaches a high potential one time in one frame period and turns on the transistor 102. The pixel electrode 105, in other words the liquid crystal capacitor 103 and the storage capacitor 104, is charged with respect to the counter electrode Vcom to the potential corresponding to that of the signal line Si at the time the transistor 102 is turned on. The scan line Gj then reaches a low potential and the transistor 102 is turned off, the potential charged to the pixel electrode being held for one frame period. While it is usual to drive liquid crystal by alternating current, it is also common to synchronize the counter electrode Vcom and common electrode Vst that is the storage capacity with the signal line Si and apply inverted pulse waveforms, whereby amplitudes to the signal line Si are reduced. Reference numeral 106 denotes a shift register and a latch on the signal side. The shift register/latch 106 sequentially samples image signals and performs serial to parallel conversion using a clock signal CKH and a start signal STH inputted from an external circuit. FIG. 10 shows an example in which a digital image signal is supplied; a plurality of bits of the image signal are converted into analog signals by a D/A converter circuit 107, and the current is amplified by an operational amplifier 108 and is applied to the signal lines S1 to Sn. The scanning side is made up of a shift register 109 and an output buffer 110 that sequentially scans the scan lines from top to bottom using a clock signal CKV and a start signal STV applied from an external circuit and drives the scan lines GI to Gm by pulse waveforms.

FIG. 11 is a set of waveform diagrams associated with each part. HD shows a horizontal synchronizing signal, a cycle thereof being a horizontal scanning period H and equivalent to the STH cycle and to the CKV cycle. The phases of these cycles may be changed slightly depending on panel characteristics and the like. An input signal is a digital image signal whose data changes according to the CKH cycle. FF1, FF2, and FF3 show sampling pulses of the shift register on the signal side. For example, in cases in which there are 4 bits and 16 gray scales, when data is represented using hexadecimal numbers, "0" in FF1, "7" in FF2, "F" in FF3 are sampled and latched. When this data is converted from digital to analog using latch pulse timing, the height of the pulse changes with respect to the counter electrode potential Vcom, and thus gray scale is realized. By performing counter-inversion, the voltage amplitude of the signal line can be about halved in the case of alternating current driving of liquid crystal, and thus this is generally carried out. It is to be noted that there has been disclosed capacitively coupled driving wherein the storage capacitor 104 of FIG. 10 is formed such that it overlaps with a pre-stage gate (Gj−1, though not shown in the figure), and pulse voltages are applied from the side of the pre-stage gate, the counter electrode potential being fixed, such that the voltage amplitude of the signal line is about halved, as is realized with counter-inversion (Japanese Unexamined Patent Application Publication No. H3-35218). The same advantageous results can be obtained with capacitively coupled driving wherein pulse voltages are applied to the storage capacitor independently of the gate, the storage capacitor 104 not overlapping the pre-stage gate (Japanese Patent Application H11-255228).

FIG. 12 shows the selection sequence of scan lines. Time is plotted on the horizontal axis and selection lines on the vertical axis. The smallest width on the time axis is a horizontal scanning period H and the number of display lines is 16. As is shown in FIG. 12, the scan lines are sequentially scanned as in the selection sequence 0→1→2→ . . . →15. Therefore, one frame is completed by 16H, at which time the writing of the next frame begins. Though omitted in FIG. 12, in practice it is possible to provide vertical blanking periods in addition to line selection periods in a frame period. It is to be noted that the horizontal scanning period H, equal to the HD cycle shown in FIG. 11, is such that the analog signal is written to a pixel within this period.

The construction of a prior art active matrix organic EL panel is shown in FIG. 13. Parts having functions corresponding to those of parts in the liquid crystal panel of FIG. 10 are accorded like reference numerals. Reference numeral 401 denotes an active matrix-type organic EL panel comprising signal lines S1 to Sn, scan lines G1 to Gm intersecting with the signal lines, and switching elements located in the vicinities of the intersection points. Si is any given signal line and Gj is any given scan line. Reference numerals 402 and 403 denote a first and a second switching element in the vicinity of the intersection point of these lines, each switching element being shown as a three-terminal thin film transistor (TFT). Reference numeral 404 denotes an auxiliary capacitor serving to maintain the voltage of the signal line Si applied to the gate electrode of the second transistor 403 via a first transistor 402. Reference numeral 405 shows the location of a pixel electrode connected to a power line Vs via a second transistor 403. Reference numeral 406 denotes an organic EL element formed between a pixel electrode 405 and a counter electrode Vcom. The organic EL element 406 emits light when current is flowed between the counter electrode Vcom and the power line Vs, and gray scale display is brought about by controlling this current. The operation of the row driver circuit and the column driver circuit is similar to that of the liquid crystal display device of FIG. 1; a scan line Gj is sequentially scanned, the first transistor 402 is turned on, and the analog voltage outputted from the signal line Si is written to the gate of the second transistor 403 and the auxiliary capacitor 404.

As is described above, in prior art active matrix liquid crystal panels and organic EL panels, gray scale display is brought about by the analog modulation of brightness. For this purpose, it has been necessary to provide a D/A converter circuit in the row driver circuit to supply an analog amount of voltage or current to the panel. However, in the stage following that of the D/A converter circuit, it has been necessary to provide an operational amplifier as a current buffer for charging and discharging the signal line capacity, which is the load. This is one cause of the increase in the power consumption of the driver circuit as a whole. This increase is explained in that the static current flows continually even at the time the operational amplifier is not charging or discharging the load and the number of operational amplifiers is as many as the total number of signal lines. Thus, the sum of the power consumption caused by the static current of the operational amplifiers increases and occupies a large proportion of the power consumption of the driver circuit as a whole.

In gray scale display of an active matrix organic EL panel, because brightness is controlled by the amount of current flowing to the organic EL elements, the panel display quality is very sensitive to variances in current-voltage characteristics of the pixel transistors. Therefore, in order to prevent degradation in image quality such as unevenness in brightness, it is necessary to make the transistor characteristics uniform across the whole panel.

As one method of solving these problems concerning power and image quality, a driving method is known wherein instead of using analog circuits such as D/A converters and operational amplifiers, gray scale display is brought about digitally by temporal modulation using only two values of fixed voltages. In the present invention this is referred to as the digital gray scale display method. With the digital gray scale display method, there is no power loss due to static current of the analog circuit and requirements on the variance of transistor characteristics for high image quality are not stringent.

FIG. 14 shows the construction of a prior art digital gray scale display method using a liquid crystal display device as the example. In comparison with FIG. 10, FIG. 14 has disposed an analog multiplexer for selecting one of two values of fixed voltages VH and VL, in other words a decoder 501 and an analog switch 502 in place of a D/A converter circuit and an operational amplifier. The decoder and the analog switch can be constructed using a very simple circuit with which there is almost no static power consumption. In the case of digital driving using organic EL also, a decoder and an analog switch are disposed in place of a D/A converter circuit and an operational amplifier as is shown in FIG. 5. Particularly when the digital gray scale display method is applied to organic EL, even if the current-voltage characteristics of the pixel transistors slightly vary, high quality images without unevenness in brightness can be provided supposing the current variation is controlled with respect to the two values of fixed voltages. It is to be noted that the scanning side is constructed using a shift register circuit for bringing about sequential scanning as is shown in FIG. 7 and the analog driving is the same as that of FIG. 10.

A method of bringing about gray scale display using two values of fixed voltages VH and VL is now explained with reference to FIG. 15. A frame period for displaying all of the pixels is divided into a plurality of sub-frame periods that are temporally weighted and by applying, in each of the sub-frame periods, VH or VL to the pixel electrode in the case of a liquid crystal display device and to the gate electrode of the second transistor in the case of an organic EL display device, temporal pulse width modulation is brought about. FIG. 15 shows an example in which there are two values of fixed voltages and the number of sub-frames corresponds to the number of input data bits, there being four bits of input data and four sub-frames. Sub-frames SF4 to SF1 are allocated accordingly the most significant bit (MSB) of input data to the least significant bit (LSB) of input data. Through the input data and the combination of the two values of fixed voltages VH and VL in the weighted sub-frames SF1 to SF4, 16 levels of gray scale display are brought about. For example, when the gray scale data is 11 in decimal, in other words "1011" in binary, in the sub-frame SF3, VL, which corresponds to "0," is selected and in the sub-frames SF1, SF2, and SF4, VH, which corresponds to "1," is selected. It is to be noted that VH may be made to correspond to "0" and VL with "1" in accordance with transmittance-voltage characteristics (T-V characteristics) of the liquid crystal elements and light-emitting-current characteristics of organic EL.

In the prior art digital gray scale display method, in order to have a construction such that the sub-frames are temporally weighted, it is necessary to select scan lines as is shown in FIG. 16. FIG. 16 shows a case in which the number of sub-frames is four and scan lines are simply sequentially scanned from top to bottom, the more significant the bit the longer the sub-frame period in order to realize sub-frames having temporal weightings of 1:2:4:8. The frame period in the case of sequential scanning by digital driving in this manner is given by $$L(1+2+4+\ldots+2^{N-1})\times H=(2^N-1)HL$$

where N is the number of sub-frames, L is the number of display lines and H is the horizontal scanning period. As is understood from the above equation, as the number of sub-frames N increases, the sub-frame period exponentially lengthens due to the portion of the equation 2 to the Nth power. In particular, in the sub-frame period corresponding to the most significant bit (MSB), the hold times of the other lines during which writing is not carried out is greatly lengthened. Thus, the frame cycle is lengthened and changes in display intensity known as flicker arise. On the other hand, when the frame frequency is fixed, there has been the problem of an increase in horizontal scanning frequency, resulting in an increase in power.

Dynamic contouring, an image quality problem specific to the digital gray scale display method, is now described. FIG.

17 shows the principle of the generation of dynamic contouring. In a case in which there are two values of fixed voltages, the number of sub-frames is four, the ratio of the sub-frame hold times is 1:2:4:8, and there are 16 levels of gray scale display, moving display is assumed and the successive changes in brightness of any given pixel over two frames is examined. In order to simplify the explanation, in FIG. 17, sub-frames are selected in order from sub-frame SF4 corresponding to the temporally most significant bit. It is supposed that in a first frame, gray scale "7," in other words "0111," is displayed and in a second frame, a gray scale "8," in other words "1000," is displayed. Thus, over 2 frames, "01111000" is displayed. Although the pattern of emitted light is accumulated and temporally averaged by the human eye, with a frame frequency of approximately 60 Hz, the pattern of emitted light, ".1111 . . . ," which should be perceived as a brightness of the intended "7" or "8," is momentarily perceived as a brightness of gray scale "16." Thus, a sudden change in the significant bit brings about dynamic contouring. In order to prevent this phenomenon, it is common practice to employ techniques wherein the number of sub-frames is increased to suppress sudden bit changes as much as possible. For example, as is shown in FIG. 18, a gray scale of 16 is appropriately chosen where the number of sub-frames is five and the ratio of sub-frame hold times is 1:2:4:4:4. In this case, the shift from gray scale "7" to gray scale "8" becomes smooth and dynamic contouring associated with this gray scale shift is reduced. Nonetheless, dynamic contouring arising with the shift from gray scale "3" to gray scale "4" remains. Supposing the number of sub-frames is again increased, dynamic contouring can be reduced yet further. In this way, it is necessary to increase the number of sub-frames in order to reduce dynamic contouring, resulting in a lengthening in the frame cycle, and supposing the frame frequency is fixed, an increase in the horizontal scanning frequency results. The consequent increase in power has been a problem.

SUMMARY OF PROBLEMS IN BACKGROUND ART

The above-described problems in the background art are summarized as follows.

(1) In display devices used in compact, battery operated, portable devices, in particular in display devices such as active matrix-type liquid crystal display devices and organic EL display devices, when multiple-level gray scale display is brought about without using analog circuits such as D/A converters and operational amplifiers by temporally weighting sub-frames with only two values of fixed voltages, the frame cycle is lengthened, resulting in the generation of flicker and an increase in power.

(2) When the number of sub-frames is increased in order to reduce dynamic contouring, a further increase in power results.

DISCLOSURE OF THE INVENTION

It is an object of the present invention to provide an active matrix display device that brings about multiple-level gray scale display by the use of sub-frames and shortens the frame period to prevent generation of flicker and an object to provide a method of driving thereof.

It is another object of the present invention to provide an active matrix display device that reduces dynamic contouring without necessitating an increase in the number of sub-frames and to provide a method of driving thereof.

The present invention realizes these and other objects by the provision of a method of driving an active matrix display device wherein one frame comprises a plurality of sub-frames each comprising a write time and a hold time and a gray scale display is brought about by the cumulative effect of the hold times, the method comprising the steps of simultaneously with outputting a signal having a value of a signal level via each of signal lines, the value of the signal level being selected from values of a plurality of signal levels in accordance with digital image data and the number of the plurality of signal levels being fewer than the number of display gray scales, randomly scanning scan lines other than one predetermined scan line in a predetermined sequence in the hold time of each of the sub-frames corresponding to the one predetermined scan line so that any one sub-frame is not written to any one scan line more than once, wherein one frame period is such that in each respective scan line, the writing of each of the plurality of sub-frames is substantially brought about and the hold time of each of the sub-frames is ensured to bring about gray scale display driving.

Selection methods according to the present invention include both cases in which the selection sequence of the sub-frame periods is repeated cyclically and cases in which the selection sequence is not repeated cyclically. In addition, there are both cases in which each sub-frame is sequentially scanned and cases in which each sub-frame is not sequentially scanned.

According to the above construction, the advantageous effects of a shortening in the frame period and a large reduction in flicker as compared to prior art digital gray scale display methods are realized.

In addition, supposing the frame frequency is fixed, the horizontal scanning period may be lengthened, making it possible to reduce the power required for the charging and discharging of the liquid crystal panel capacity carried out at this time.

The invention also makes it possible to simplify the construction of a driver circuit without necessitating D/A converter circuits or operational amplifiers and to realize a reduction in power consumption.

In the present invention, there are also driving methods where the scan lines are selected such that the selection sequence of the sub-frame periods is repeated cyclically as in SF1→SF2→ . . . SFn→SF1→SF2→ . . . →SFn. In a driving method such as this, the selection method of the scan lines is not necessarily such that each sub-frame is sequentially scanned.

There are also driving methods where the scan lines are selected such that the selection sequence of the sub-frame periods is repeated cyclically as in SF1→SF2→ . . . →SFn→SF1→SF2→ . . . →SFn and sequential scanning is brought about with respect to each of the sub-frame periods.

There are also cases where driving is such that the frame period is set to $$NH[1+K(2^N-1)]=NHL$$

where N is the number of sub-frames, H is a horizontal scanning period, 1:2:4: . . . :$2^{N-1}$ is the weightings of the hold times, L is the number of scan lines, and K is a positive integer.

There are also cases where the driving is such that the frame period is set to $$NH[1+\Sigma K(i)]=NHL$$

where N is the number of sub-frames, H is a horizontal scanning period, K(i) is the weighting of the hold time of the period of an ith sub-frame where i=1, 2, . . . , N, and L is the number of scan lines.

There are also cases where simultaneously with outputting a signal having a value of a signal level via each of signal lines, the value of the signal level being selected from values of a plurality of signal levels in accordance with digital image data and the number of the plurality of signal levels being at least three and fewer than the number of display gray scales, the degree of freedom of the signal levels usable for one gray scale is made two within the period of the one frame.

The number of the values of the plurality of signal levels may be two or a plurality of three or more. Particularly the case of a plurality of values (use of multiple-values), as in three or more, denotes the use of both digital and analog in carrying out gray scale display. In addition, in such cases using multiple-values, there is the advantage of being able to increase the number of display gray scales without increasing the number of sub-frames. For this reason, as long as gray scale is appropriately selected so that sudden bit shifts between two adjacent gray scales is reduced, it is made possible to suppress image quality degradation caused by dynamic contouring without increasing the number of sub-frames.

The present invention also includes active matrix display devices constructed so that the driving method described above is realized.

The active matrix display devices may be a liquid crystal display device having a liquid crystal layer or an organic EL display device provided with a luminescent layer.

BEST MODE FOR CARRYING OUT THE INVENTION

Embodiment 1

Figure 1:
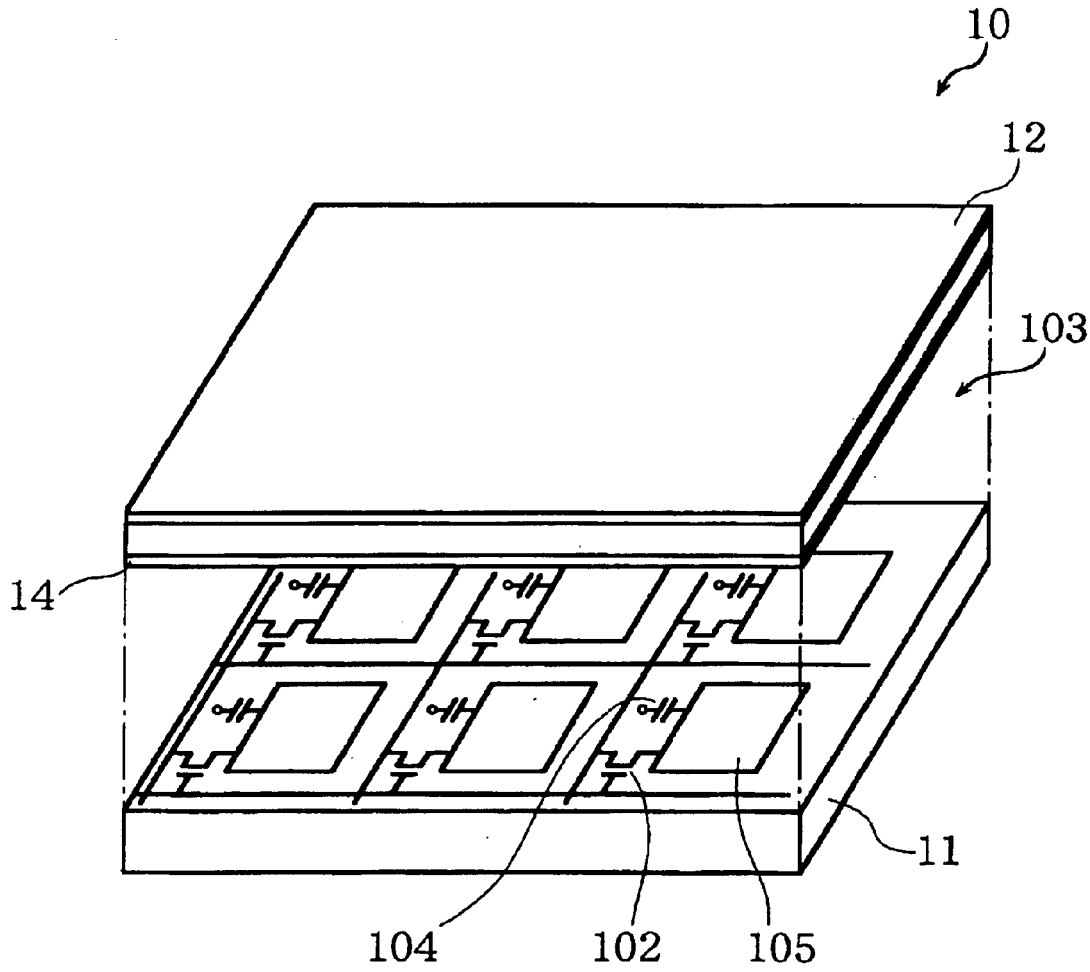
FIG. 1 shows the structure of the main parts of an active matrix liquid crystal display device 10 in accordance with embodiment 1.
Figure 2:
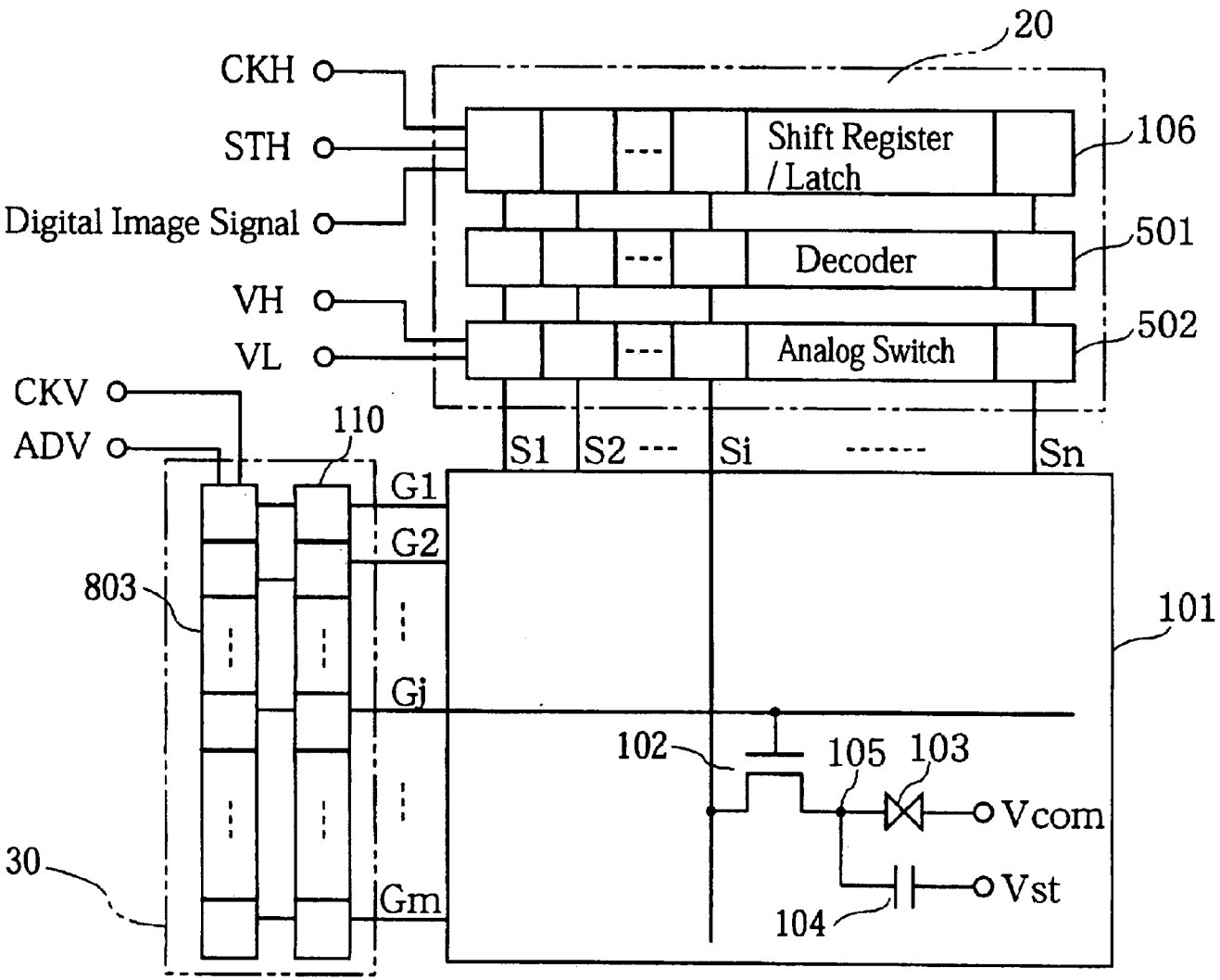
FIG. 2 is an electrical circuit diagram of the liquid crystal display device 10.

FIG. 1 shows the structure of the main parts of an active matrix liquid crystal display device 10 in accordance with embodiment 1. FIG. 2 is an electrical circuit diagram of a liquid crystal display device 10. Parts of the liquid crystal display device of the present embodiment 1 corresponding to parts of the examples from prior art shown in FIGS. 10 to 14 are accorded the same reference numerals, and detailed description is omitted. The liquid crystal display device 10 is an active matrix display device such that one frame comprises a plurality of sub-frames SF1, SF2, . . . , SFn (when referring to the sub-frames generally, the abbreviation SF is used) each comprising a write time and a hold time and a gray scale display is brought about by the cumulative effect of the hold times. The liquid crystal display device 10 comprises a first substrate 11, a second substrate 12 disposed such that it opposes the first substrate 11, and a liquid crystal layer 103 sealed between the substrates 11 and 12. On the inside surface of the first substrate 11, thin film transistor (TFTs) 102, pixel electrodes 105 connected to the TFTs 102, and storage capacitors 104 connected to the pixel electrodes 105 are formed. The TFTs 102 serve as switching elements located at each intersection point of a plurality of signal lines S1, S2, . . . , Sn (when referring to the signal lines generally, the abbreviation S is used) and a plurality of scan lines G1, G2, . . . , Gm (when referring to the scan lines generally, the abbreviation G is used) arranged in a matrix. On the inside surface of the second substrate 12, a counter electrode 14 is formed.

Reference numeral 20 denotes a signal line driver circuit. The signal line driver circuit 20 comprises a shift register/latch circuit 106 (for simplification, the shift register and the latch are represented together by one block in the diagram), a decoder 501, and an analog switch 502. The decoder 501 and the analog switch 502 make up an analog multiplexer for selecting either of the two values of fixed voltages VH and VL in accordance with digital image data. According to this construction, the signal line driver circuit 20 carries out the function of outputting a voltage having a value of a voltage level via each signal line S, the value of the voltage level being selected from values of a plurality of voltage levels set in advance (in the present embodiment 1, the two values of fixed voltages VH and VL) in accordance with digital image data and the plurality of voltage levels being fewer than the number of display gray scales.

Reference numeral 30 denotes a scan line driver circuit. The scan line driver circuit 30 is made up of a decoder 803 for selecting a scan line G as designated by an address signal ADV and an output buffer 110. The decoder 803 is constructed such that an address signal ADV outputted from a controller circuit (not shown in diagram) is supplied and the scan line addressed by the address signal ADV is selected. The addressing sequence is stored in advance in the memory of the controller circuit (not shown in diagram), and based on this memory, scan lines are scanned randomly in a specified sequence as is described later.

Figure 15:
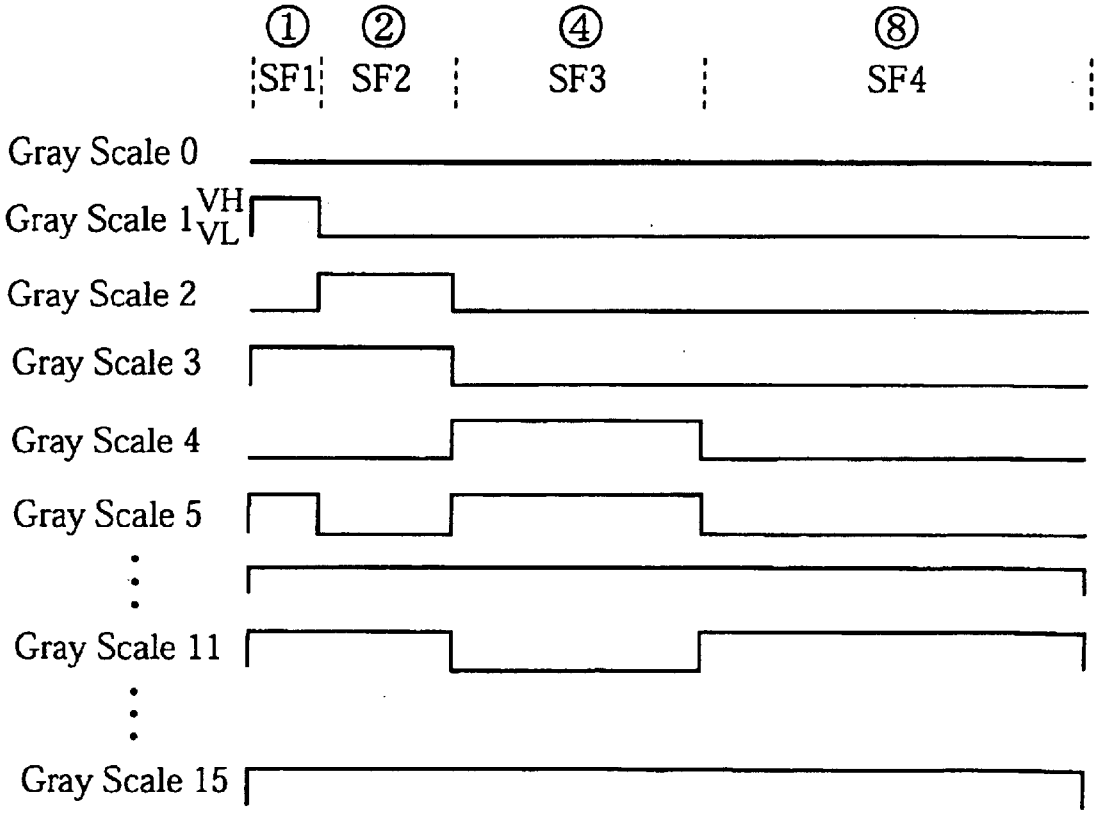
FIG. 15 is a diagram showing the relationship between gray scale and sub-frames in a digital gray scale display.

A method of driving the liquid crystal display device 10 is now described. In embodiment 1, a frame period for displaying an entire image is divided into a plurality of sub-frame periods that are temporally weighted. By selectively outputting a voltage having either of the two values of fixed voltages VH or VL in each sub-frame period, temporal pulse width modulation is brought about. An example of the relationship between gray scale data and the combination of the two values of fixed voltages in each sub-frame is shown in FIG. 15, but other combinations, different from that shown in FIG. 15, are also possible.

Figure 3:
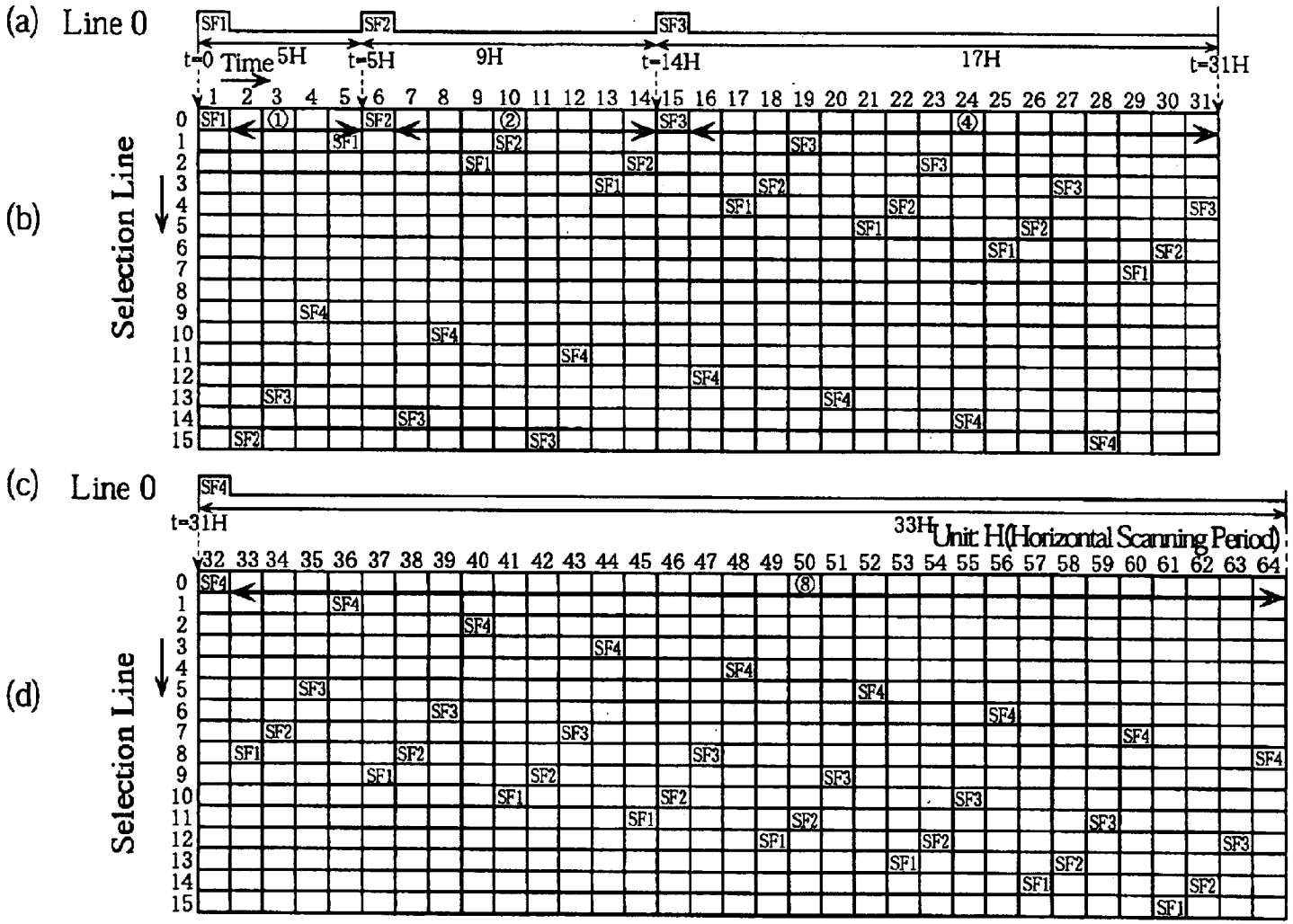
FIG. 3 is a diagram of a driving sequence showing a scan line selection sequence of embodiment 1.

A specific driving sequence is shown in FIG. 3. FIG. 3 shows an example of a case in which there are 16 scan lines ranging from a zeroth scan line to a fifteenth scan line, two values of fixed voltages, and four of both the number of sub-frames and the number of bits of input gray scale data. FIG. 3(*a*) and FIG. 3(*c*) show the sub-frame of the zeroth scan line. FIG. 3(*b*) and FIG. 3(*d*) show the scan line selection sequence. It is to be noted that FIG. 3(*a*) and FIG. 3(*c*) together show one frame period; although FIG. (c) is the continuation of FIG. (a), the diagram was divided into two parts in consideration of space. Similarly, FIG. 3(*b*) and FIG. 3(*d*) together show one frame period; although FIG. 3(*d*) is the continuation of FIG. 3(*b*), the diagram was divided into two parts in consideration of space.

Referring to FIG. 3, a specific driving method is described below. The period of each sub-frame SF1 to SF4 comprises a write time and a hold time, the write time being fixed at one horizontal scanning period (1H) in all of the sub-frames and the hold time being weighted in every sub-frame by the product of the horizontal scanning period, 2 raised to a power, and a constant. In other words, supposing the hold time of the sub-frame SF1 is taken to be 4H, that of the sub-frame SF2 is 8H, that of sub-frame SF3 16H, and that of sub-frame SF4 32H.

In the above, it is an object of the driving method of the present invention to shorten the frame period. Thus, in order to achieve this object, scan lines other than one predetermined scan line (in the case of FIG. 3, the first to the fifteenth scan line) are randomly scanned in a predetermined sequence in the hold time of each sub-frame corresponding to the one predetermined scan line (in the case of FIG. 3, the zeroth scan line) so that any one sub-frame is not written to any one scan line more than once and one frame period is such that the writings and the hold time of each of the sub-frames with respect to all of the scanning lines are ensured to bring about gray scale display.

In setting up a specific scan line selection sequence in order to achieve the object described above, the sub-frame periods must first be generalized. The ith sub-frame period (where i=1, 2 . . . , N) is given by $$(1+2^{i-1}\times NK)\times H$$

where H is one horizontal scanning period, N is the total number of sub-frames, and K is a positive integer. In the above expression, the first term in the parentheses is the write time and the second term is the hold time. The hold time is given by (2 raised to a power)×(a constant K)×(the number of sub-frames N)×(the horizontal scanning period H) and the (2 raised to a power) portion of the expression is weighted by 1, 2, 4, 8 . . . in every sub-frame. The term NK is included in the hold time because it is useful in shortening the frame period as is described later.

Because one frame period is the sum of all the sub-frame periods, it is given by $$[N+NK(1+2+4+\ldots+2^{(N-1)})]\times H=NH[1+K(2^N-1)].$$

In the waveform diagram of FIGS. 3(*a*) and 3(*c*), the pulse portions correspond to the write times and all other portions correspond to the hold times.

The scan line selection sequence is not such that the lines are simply scanned from the top to the bottom, but rather as is shown in FIGS. 3(*b*) and 3(*d*), such that lines are selected in a specified sequence. Thus, the hold time of the sub-frame period in the significant bit is used to write the sub-frames of other lines, and thus the frame period is shortened. A specific method of shortening the frame period is carried out by employing the procedure described below.

(1) Setting the Number of Display Scan Lines

In order to write all of the sub-frames in one frame period, N write times are necessary per line. Therefore, when the number of display scan lines is L, the write time necessary for one frame period is the product of one horizontal scanning period and (N×L). In other words, the write time is given by NHL. When the hold time is used to write other lines, the most efficient case is given by $$NH[1+K(2^N-1)]=NHL.$$

Therefore, the number of display scan lines may be selected such that $$L=1+K(2^N-1).$$

Because in the example of FIGS. 3(*b*) and 3(*d*) the number of sub-frames N=4, the number of display scan lines L=15K+1. K is a positive integer, and when K=1, 2, 3 . . . L=16, 31, 46 . . . In FIGS. 3(*b*) and 3(*d*), K=1, and thus the number of display scan lines L=16 and one frame period is such that NHL=64H.

(2) Setting the Scan Line Selection Sequence

Next, the scan line selection sequence is explained in detail. FIG. 3 shows a case in which the number of sub-frames N=4 and the number of display scan lines L=16 (K=1). The sub-frame periods are 5H, 9H, 17H, and 33H, respectively, and one frame period is 64H, the sum of these sub-frame periods. Looking at the top zeroth scan line, we see that from time t=0 throughout the horizontal scanning period 1H, sub-frame SF1, corresponding to the least significant bit, is written. Subsequently, there is a hold time of 4H, and the writing of SF2 to the zeroth scan line occurs at t=5H. During the hold time of this SF1, the sub-frames of other scan lines are written. Specifically, the SF2 of the fifteenth scan line is written at t=1H, the SF3 of the thirteenth scan line at t=2H, the SF4 of the ninth scan line at t=3H, and the SF1 of the first scan line at t=4H. In other words, the sequence of writing the sub-frames is repeated cyclically as in SF1→SF2→SF3→SF4→SF1 . . . It is understood from examining one sub-frame, for example SF4, that the selection sequence is sequentially scanned, the start line being 9, as in 9→10→11→ . . . →15→0→1 → . . . →8. The sequential scanning is similarly brought about with other frames except that the start line changes. In determining the time of writing each of the sub-frames with respect to the zeroth line, the start line of each sub-frame is automatically determined.

In this manner, by selecting scan lines such that the hold times of sub-frames are used to write the sub-frames of other lines, the frame period is shortened by a factor of $N/(2^N-1)$ as compared with a case in which the sub-frame construction is such that lines are simply sequentially scanned.

Figure 16:
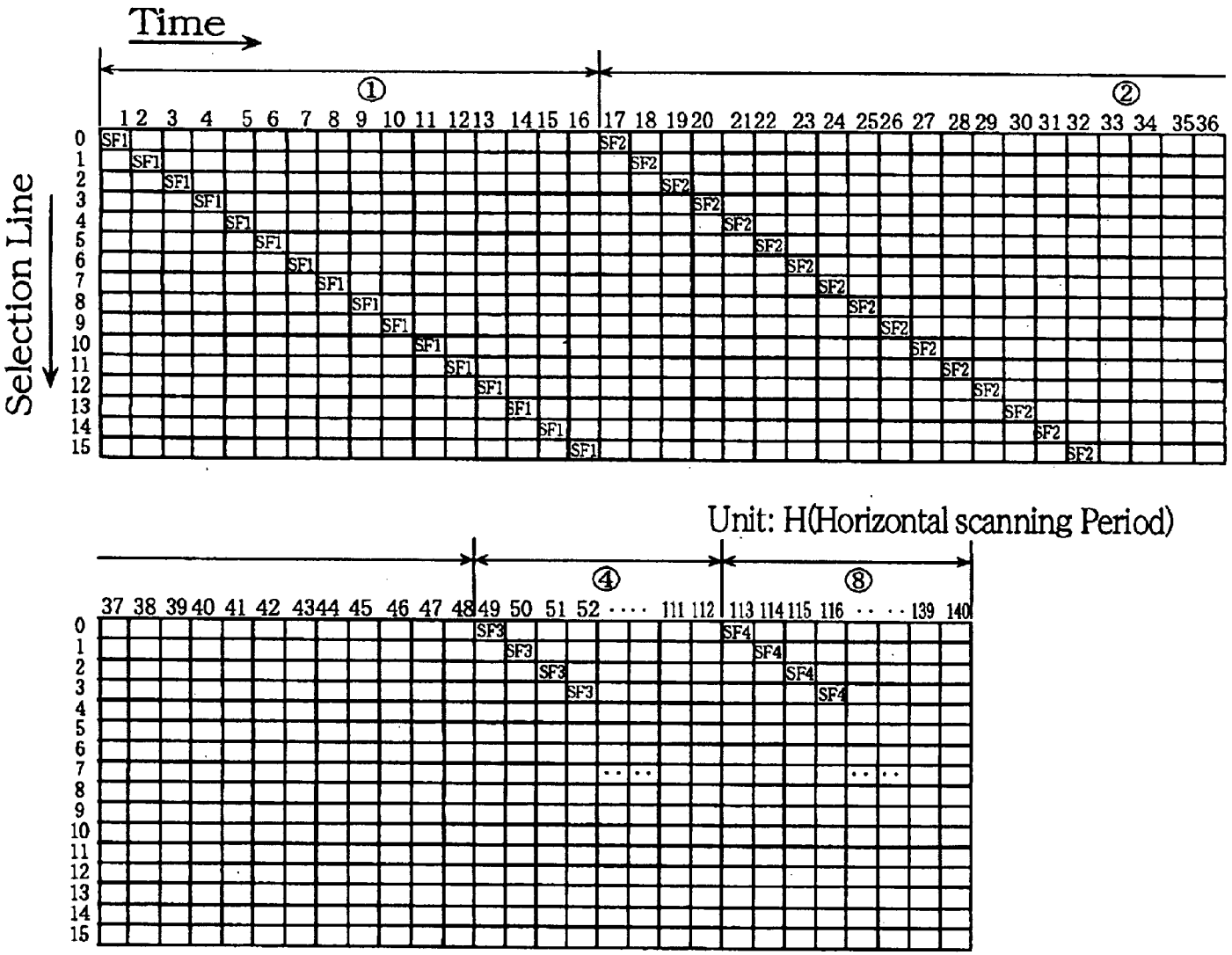
FIG. 16 is a diagram showing a scan line selection sequence in a prior art digital gray scale display.
Figure 17:
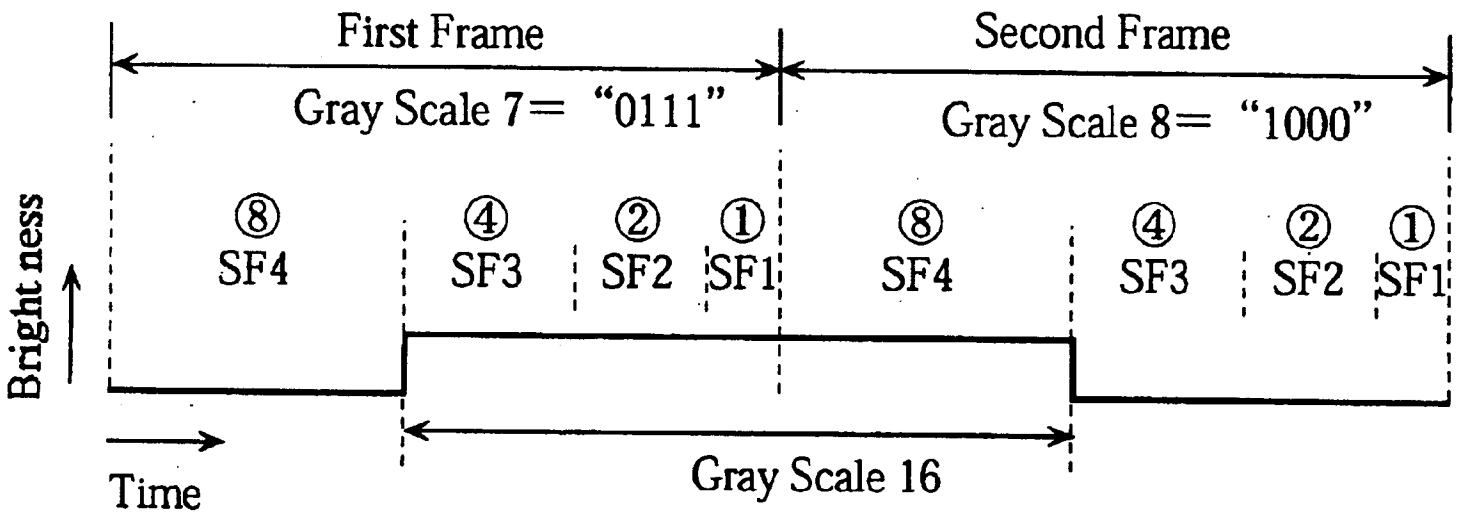
FIG. 17 is a diagram showing the principle of dynamic contouring generation in a digital gray scale display.
Figure 18:
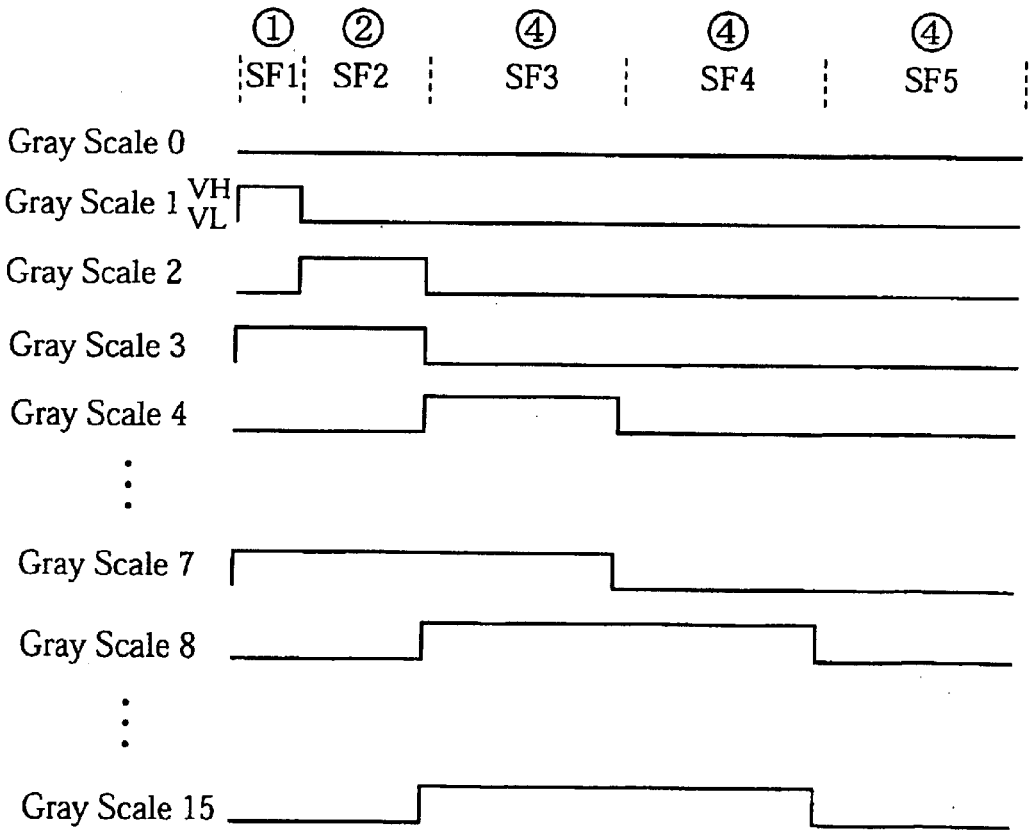
FIG. 18 is a diagram showing a method of reducing dynamic contouring in a prior art digital gray scale display.

For example, FIG. 3 and FIG. 16 have the same number of display scan lines and the same number of sub-frames, but while the sequential scanning of FIG. 16 has a frame cycle of 240H, that of FIG. 3 has a frame cycle of 64H. Shortening the frame cycle makes it possible to prevent changes in display intensity known as flicker. By fixing the frame frequency, it is also possible to lengthen the horizontal scanning period and thus reduce the power necessary for the charging and discharging of the liquid crystal panel capacity to be carried out during this horizontal scanning period.

Figure 4:
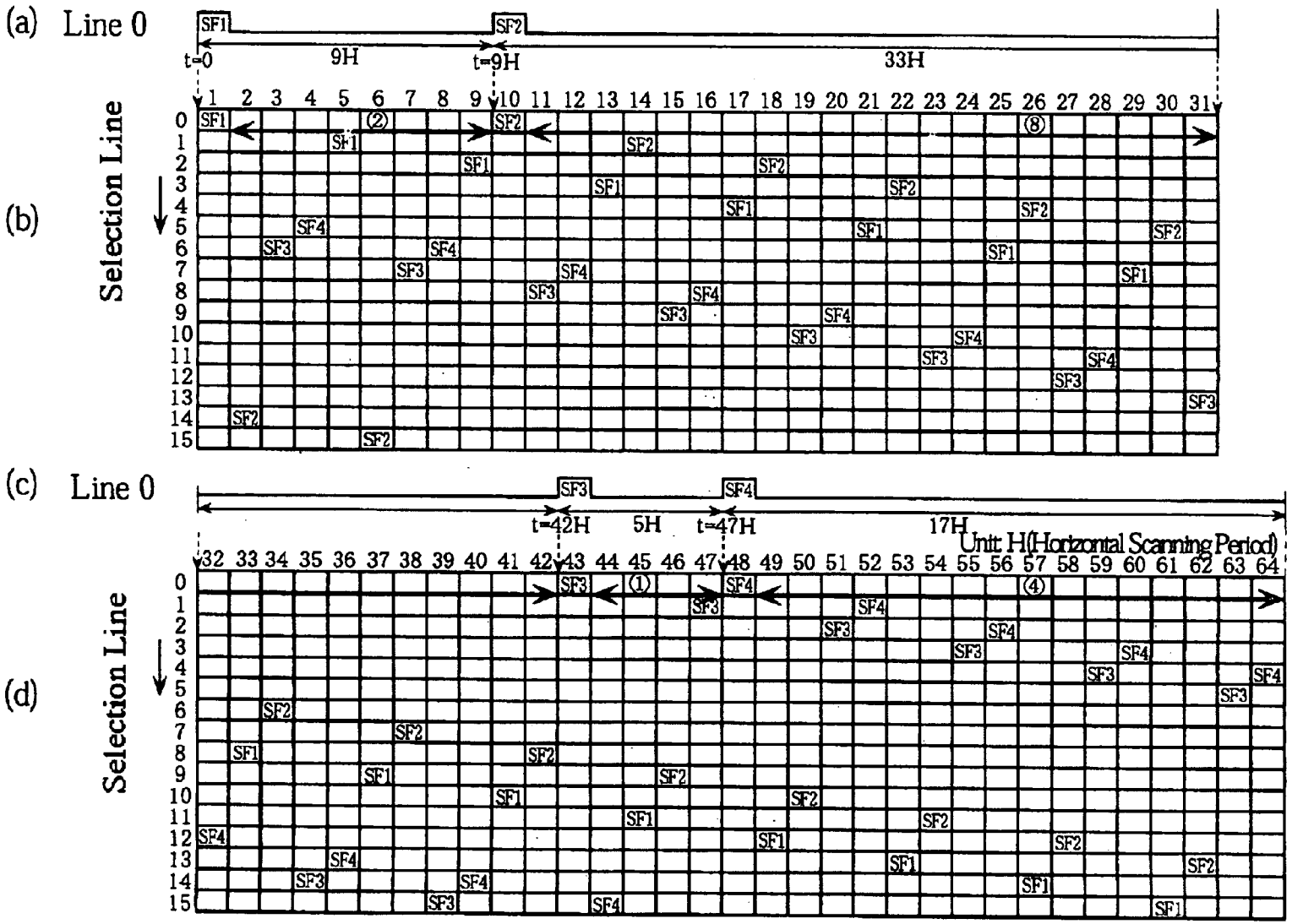
FIG. 4 is a diagram of a driving sequence showing an alternative example of a scan line selection sequence of embodiment 1.

In the example above, the ratio of sub-frame hold times was set to SF1:SF2:SF3:SF4=1:2:4:8, but the present invention is not limited to this. For example, even if the ratio is set to SF1:SF2:SF3:SF4=2:8:1:4, supposing the scan line selection sequence is as shown in FIG. 4 according to similar thinking as that described above, shortening of the frame period is achieved.

Figure 5:
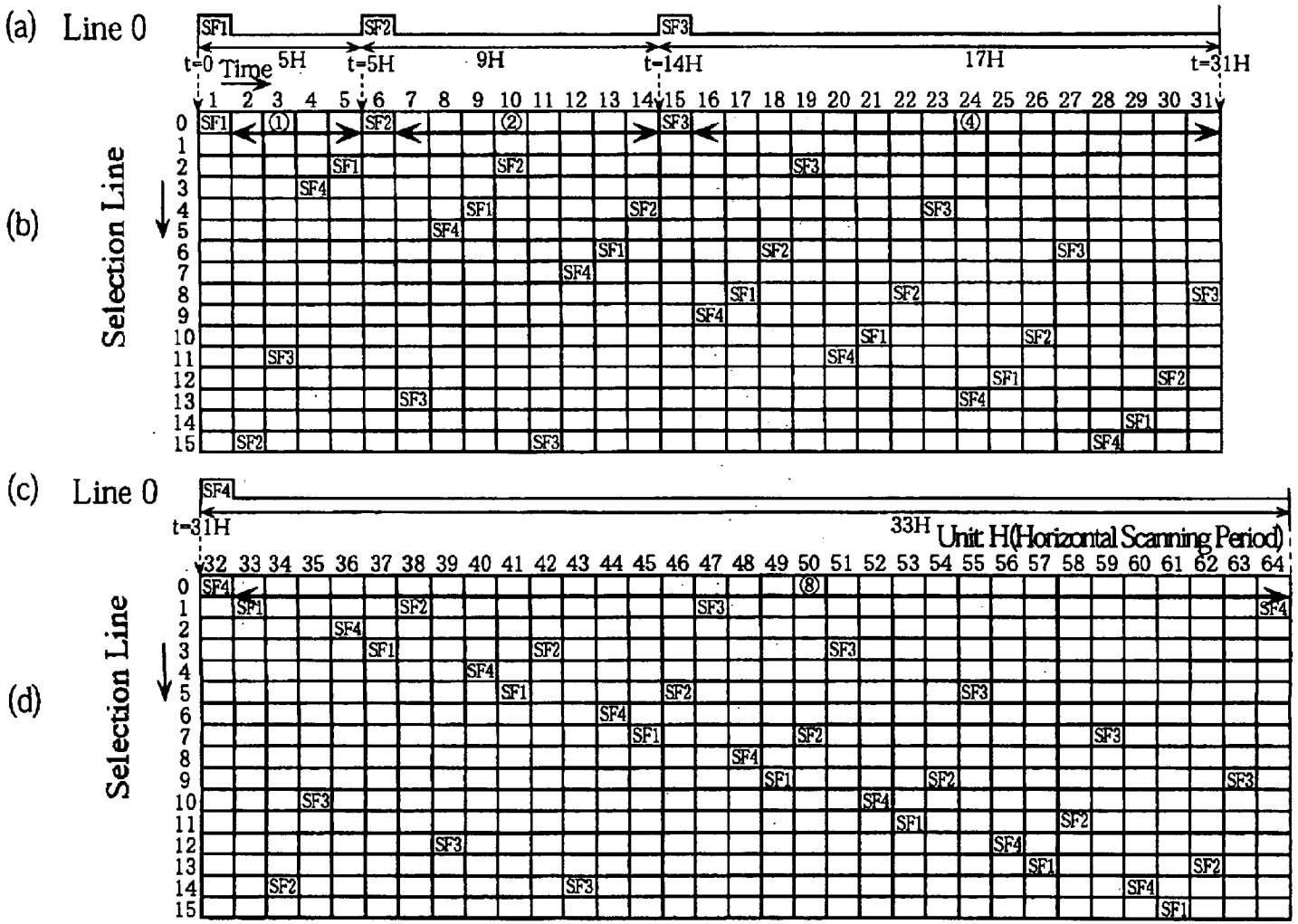
FIG. 5 is a diagram of a driving sequence showing an alternative example of a scan line selection sequence of embodiment 1.

In addition, in the example above, the selection sequence of the sub-frame periods was repeated cyclically as in SF1→SF2→SF3→SF4→SF1 . . . , and scan lines were selected to bring about sequential scanning with respect to each of the sub-frame periods. However, the present invention is not limited to this. For example, as is shown in FIG. 5, while the selection sequence of the sub-frame periods is repeated cyclically as in SF1→SF2→SF3→SF4→SF1 . . . , it is possible to select the scan lines such that sequential scanning is not brought about with respect to each of the sub-frame periods. In the case of FIG. 5, it is understood from examining SF4, for example, that the selection sequence is such that every other line is skipped as in 3→5→7→9→→11→13→15→2→4→ . . . →14→3→5→, line 3 being the start line. Other lines are similarly scanned such that every other line is skipped. Even if scan lines are selected such as in FIG. 5, shortening of the frame period can be achieved. It is to be noted that sequential scanning can simplify the address circuitry that designates the scan lines.

Furthermore, in the example above, the sub-frame periods were repeated cyclically in order of weighting from smallest to largest as in SF1→SF2→SF3→SF4→SF1→ . . . and scan lines were selected, but the sub-frame periods may also be in order of weighting from largest to smallest as in SF4→SF3→SF2→SF1→SF4→ . . . . Alternatively, the sub-frame sequence may be set freely with no relation to weighting, as in for example, SF3→SF1→SF4→SF2→SF3→ . . . .

Also in the example above, the cycle of sub-frames to be repeated cyclically was set to a 4H cycle to correspond with the number of sub-frames N=4, however, it may be set to a multiple of N. For example, when N=4, the sub-frames may be repeated cyclically with the cycle set to an 8H cycle. In addition, the sub-frame sequence may be altered such that several lines are skipped, the lines are divided into even lines and odd lines, or the like in each block comprising a plurality of lines selected from all of the lines. In such cases, each of the sub-frames is not necessarily sequentially scanned.

Summary of Methods of Selecting Scan Lines

In summarizing the methods of selecting scan lines, the methods may be broadly classified into three categories.

(1) Scan lines other than one predetermined scan line selected from a plurality of scan lines are randomly scanned in a predetermined sequence in the hold time of each sub-frame corresponding to the one predetermined scan line so that any one sub-frame is not written to any one scan line more than once, and one frame period is such that in each respective scan line, the write and hold time of each of the plurality of sub-frames is substantially ensured.

In this selection method, both cases where the sub-frame period selection sequence is repeated cyclically and cases where the sub-frame period selection sequence is not repeated cyclically are included. As for each of the sub-frames, cases with sequential scanning and cases without sequential scanning are included. This selection method makes it possible to shorten the frame period by effectively utilizing the hold times.

(2) Scan lines are selected so that the selection sequence of the sub-frame periods is repeated cyclically as in SF1→SF2→ . . . →SFn→SF1→SF2→ . . . →SFn.

With this selection method, each of the sub-frames is not necessarily sequentially scanned. This selection method makes it possible to even more effectively utilize the hold times as compared with the selection method (1) above such that the frame period is shortened as much as is possible and to simplify the address circuit that designates the scan lines.

(3) The selection sequence of the sub-frame periods SF1→SF2→ . . . →SFn→SF1→SF2→ . . . →SFn is repeated cyclically, and the scan lines are selected to bring about sequential scanning with respect to any one sub-frame period. With this selection method, as compared with the selection methods (1) and (2) above, the address circuit for designating scan lines can be constructed using a counter circuit having a simplified construction.

Though the thinking behind the selection methods (1) to (3) for selecting scan lines differ, the same driving sequences in terms of results may arise.

In the example above, the sub-frame hold time is given by (2 raised to a power)×(a constant K)×(the number of sub-frames N)×(the horizontal scanning period H), though it is possible to arbitrarily fix the portion (2 raised to a power)×(a constant K). Generally, if the weighted portion (the constant K)×(2 raised to a power) is replaced with K(i), the hold time is given by NH·K(i), and the ith sub-frame period (where i=1, 2, . . . , N) is given by $$[1+N\cdot K(i)]\times H.$$

Because one frame period is the sum of all of the sub-frame periods, it is given by $$NH[1+K(1)+K(2)+\ldots+K(N)]=NH[1+\Sigma K(i)].$$

In order to shorten the frame period, supposing one frame period is made to be NHL, the number of display scan lines is given by $$L=1+K(1)+K(2)+\ldots+K(N)=1+\Sigma K(i).$$

In this case also, the scan line selection sequence may be set according to the same thinking as that of the case where the hold time of the sub-frames is (2 raised to a power)×(a constant K)×(the number of sub-frames N)×(the horizontal scanning period H).

Supplementary Explanation to Embodiment 1

Concerning the alternating current driving of the liquid crystal display device in the present embodiment, counter-inversion driving is assumed as is the case in prior art examples, and there are two values of fixed voltages. However, cases where the voltage of the counter electrode is fixed may also be applied by having a total of four values of fixed voltages, two values of positive polarity and two values of negative polarity, respectively. By employing pre-stage gate capacitively coupled driving or capacitively coupled driving for controlling the storage capacity independently, it is made possible to fix the voltage of the counter electrode with the number of values of fixed voltages kept at two.

In the present embodiment, the number of display lines was set to L=16 by making the number of sub-frames N=4 and the constant K=1. However, this is the maximum number of lines that can be displayed. For practical purposes, the number of lines may be fewer than this. For example, in cases in which the maximum number of lines capable of being displayed is set to L=16 and the actual number of lines displayed is 15 lines, the length of time during which no line is selected only arises for a time of 4H.

Embodiment 2

Figure 6:
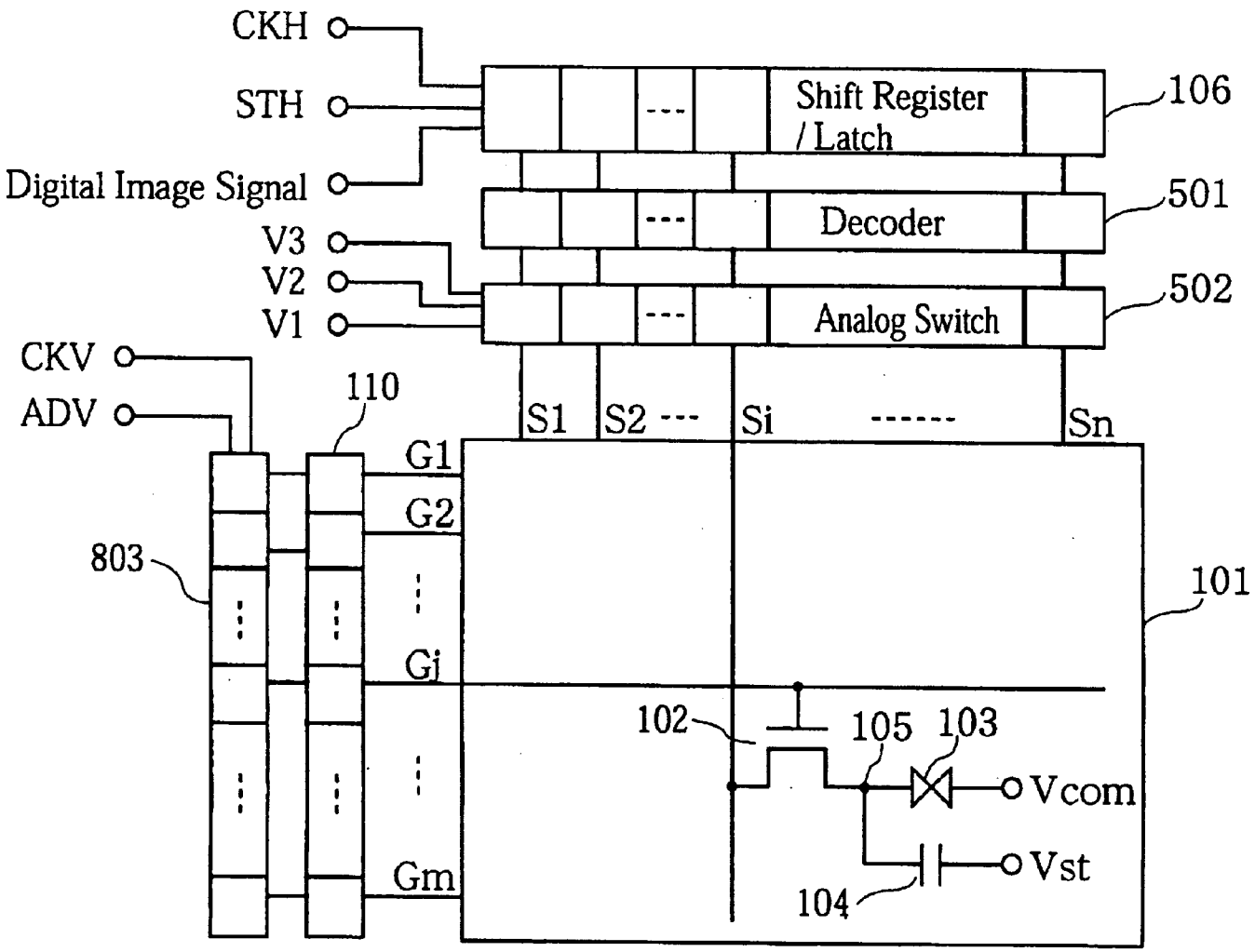
FIG. 6 is an electrical circuit diagram of a liquid crystal display device 10A in accordance with embodiment 2.

FIG. 6 is an electrical circuit diagram of a liquid crystal display device 10A in accordance with embodiment 2. In embodiment 2, parts corresponding to those of embodiment 1 are accorded the same reference numerals. In embodiment 1, gray scale display is brought about by the combination of two values of fixed voltages in a plurality of sub-frames that are temporally weighted. However, in the present embodiment 2, gray scale display is brought about by the combination of three or more values of fixed voltages. This phenomenon denotes gray scale display by multiple-valued sub-frames; in other words, gray scale display brought about by both digital and analog means.

Figure 7:
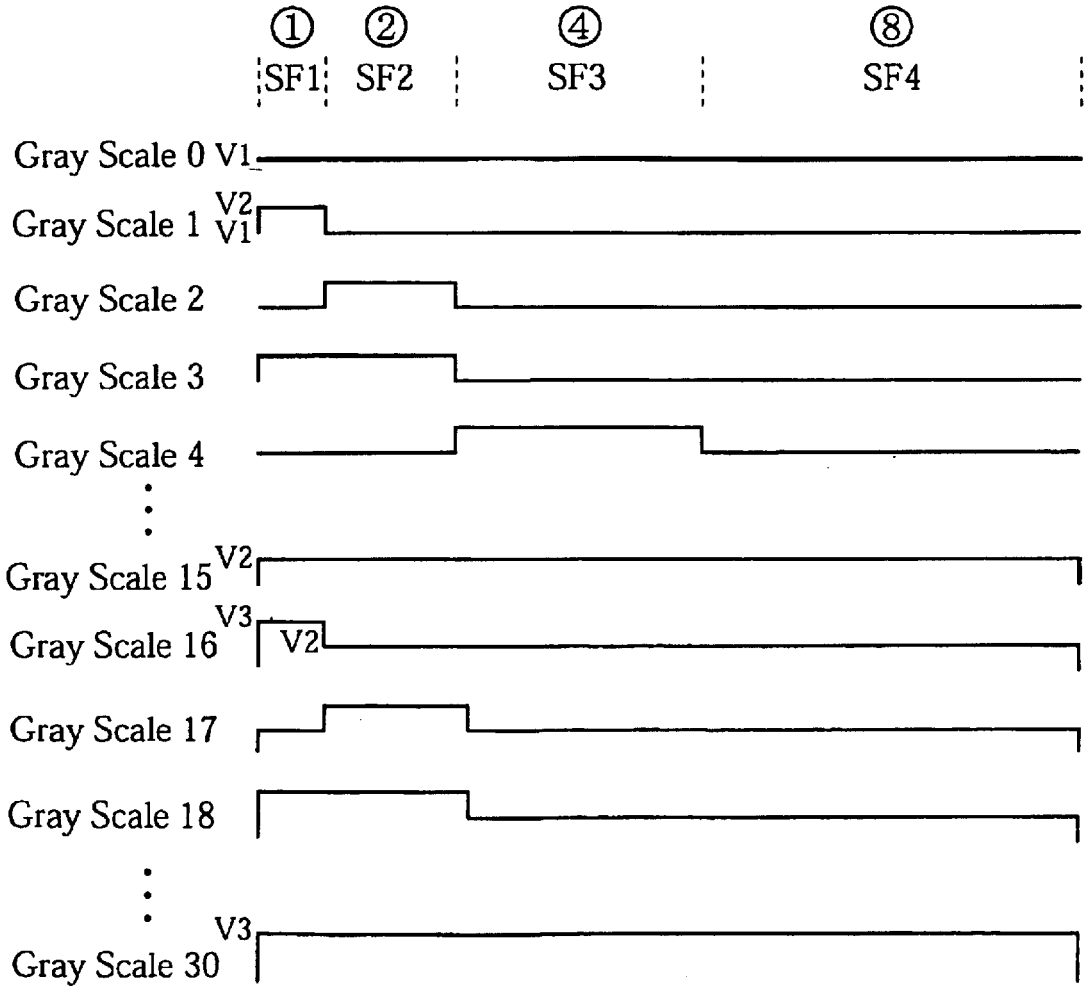
FIG. 7 is a diagram showing the relationship between gray scale and sub-frames in embodiment 2.

With such cases using multiple-values, the construction of the circuit for the analog multiplexer (decoder and switch) that selects the fixed voltage on the signal-side driver circuit becomes complex, but there is the advantage of being able to increase the number of display gray scales without increasing the number of sub-frames. For example, as is shown in FIG. 7, when there are three values of fixed voltages, four sub-frames, and a hold time ratio of 1:2:4:8, if the degree of freedom of usable fixed voltages for one gray scale is two, a maximum number of 31 gray scales can be obtained.

Figure 8:
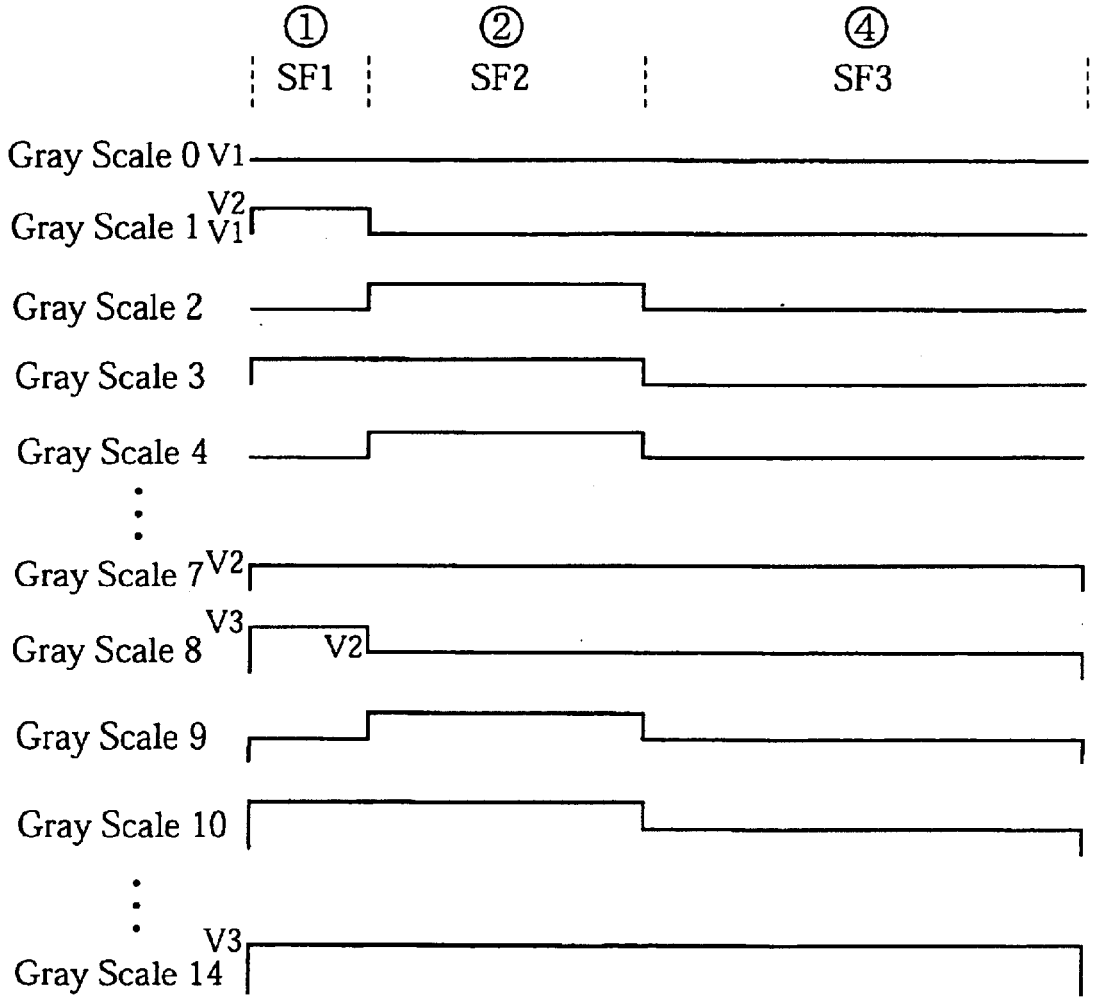
FIG. 8 is a diagram showing an alternative example of the relationship between gray scale and sub-frames in embodiment 2.

On the other hand, use of multiple values makes a reduction in the number of sub-frames possible. For example, as is shown in FIG. 8, when there are three values of fixed voltages, three sub-frames, and a hold time ratio of 1:2:4, if the degree of freedom of usable fixed voltages for one gray scale is two, a maximum number of 15 gray scales can be obtained. Reduction in the number of sub-frames makes it possible to even further shorten the frame cycle, and by fixing the frame frequency, the horizontal scanning frequency can be reduced, making a reduction in power possible. With the use of multiple values, when for one gray scale, the degree of freedom of usable fixed voltages is two, jumps in brightness between adjacent gray scales is prevented and gray scale-brightness characteristics are maintained.

Figure 9:
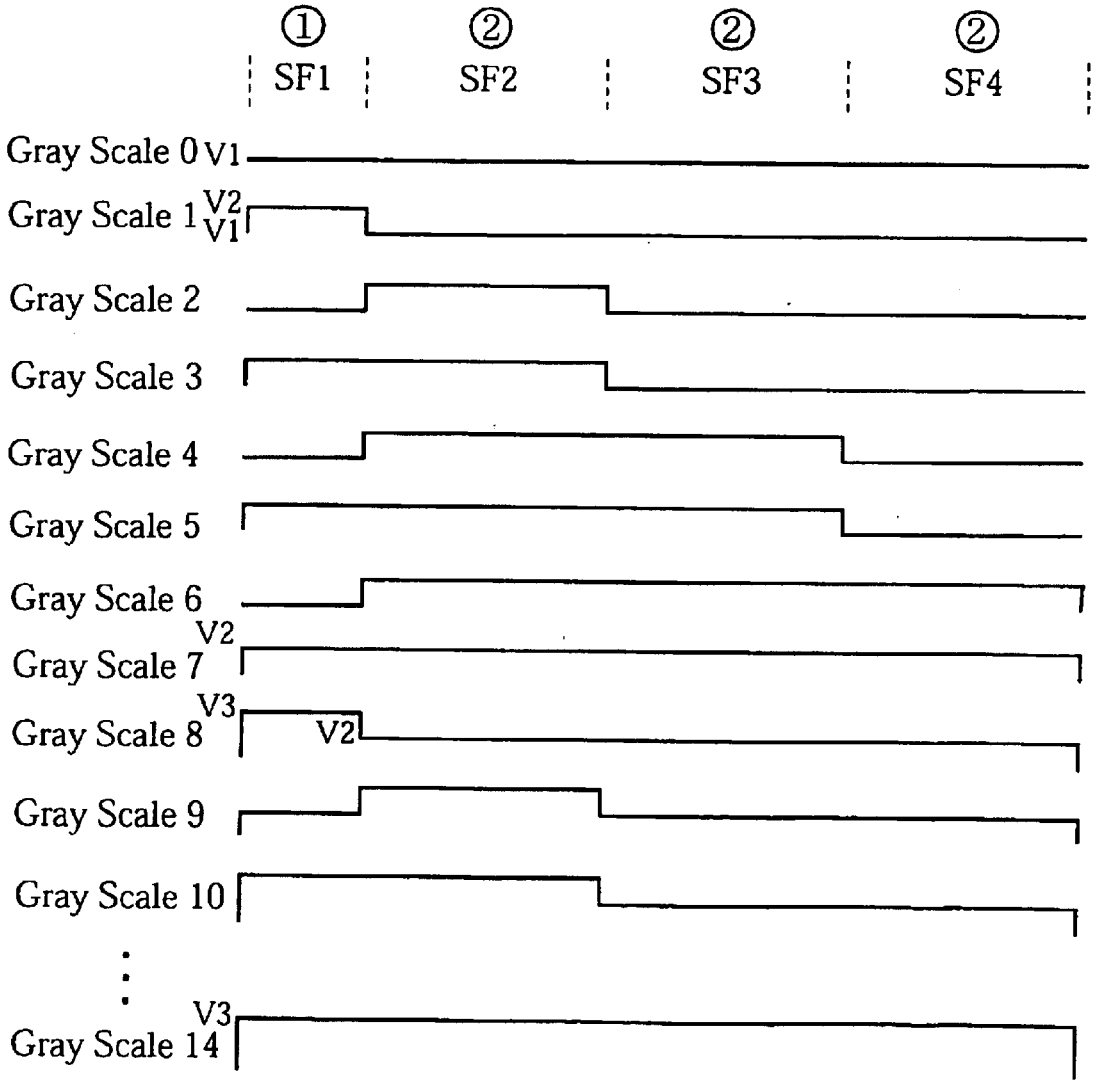
FIG. 9 is a diagram showing an alternative example of the relationship between gray scale and sub-frames in embodiment 2.
Figure 10:
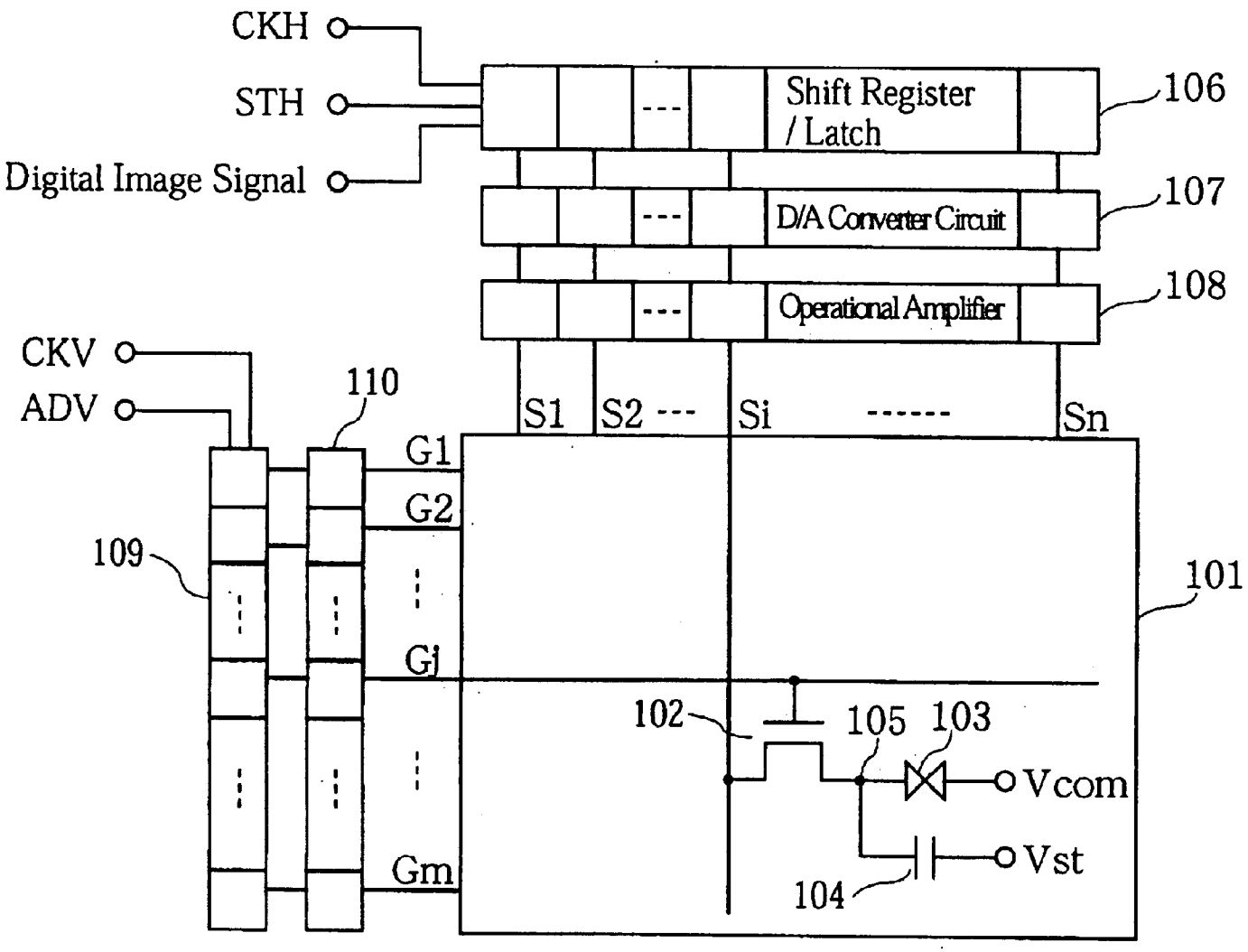
FIG. 10 is a diagram showing the construction of an analog gray scale display in a prior art active matrix liquid crystal panel.
Figure 11:
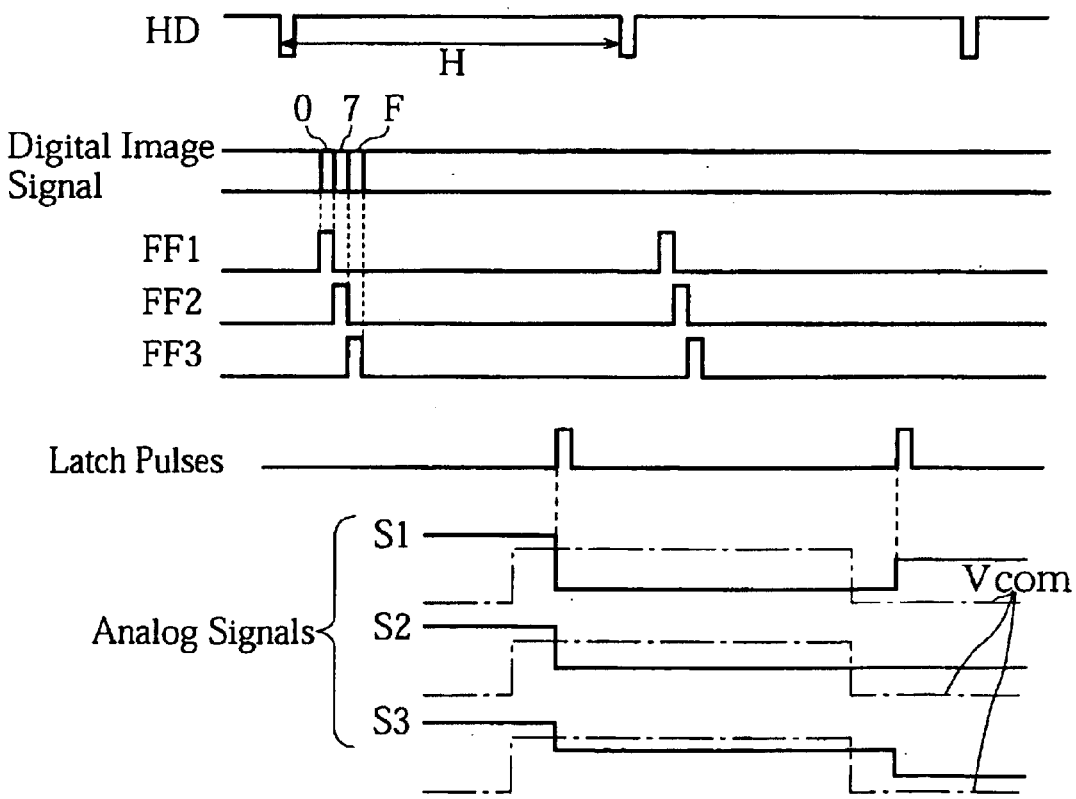
FIG. 11 is a waveform diagram of an analog gray scale display in a prior art active matrix liquid crystal panel.
Figure 12:
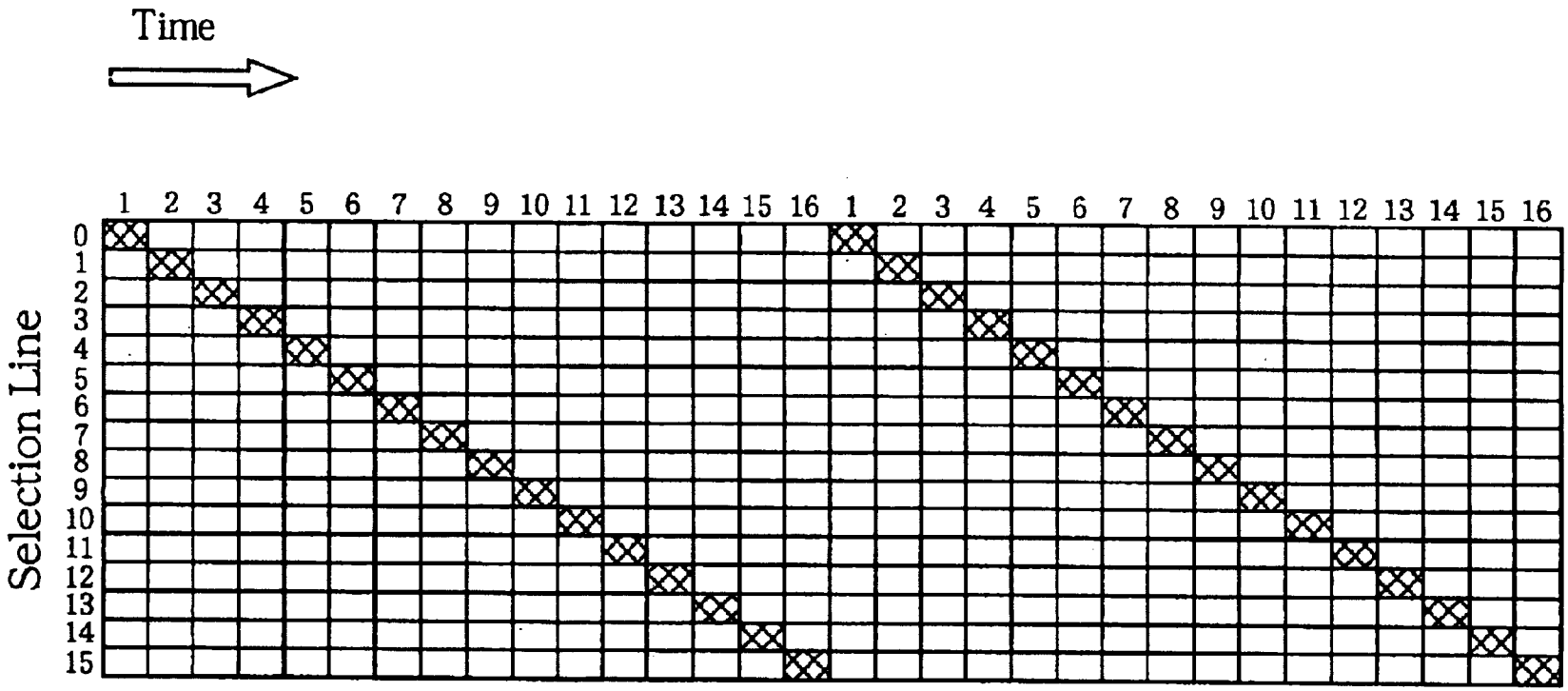
FIG. 12 is a diagram showing a scan line selection sequence in a prior art analog gray scale display
Figure 13:
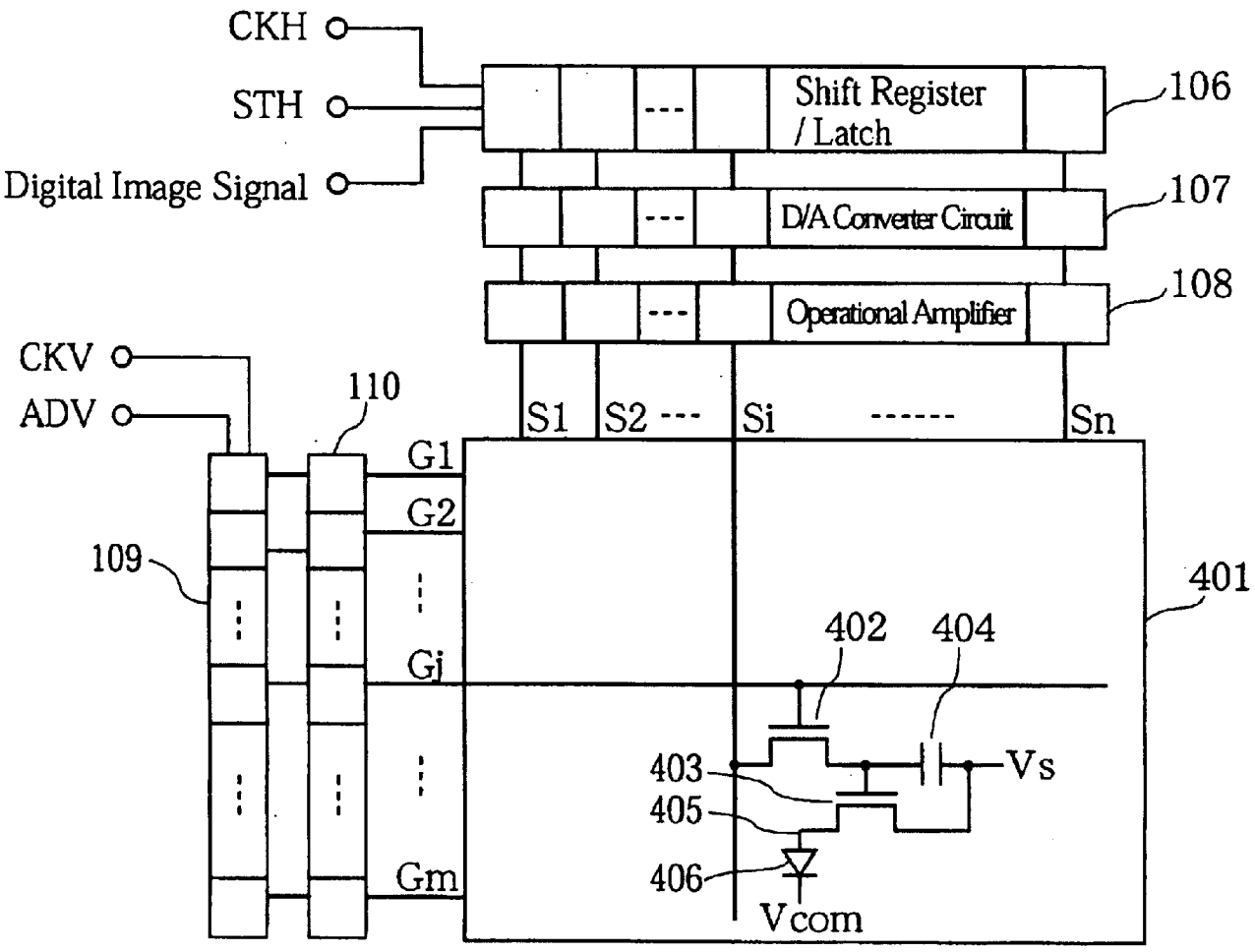
FIG. 13 is a diagram showing the construction of an analog gray scale display in a prior art active matrix organic EL panel.
Figure 14:
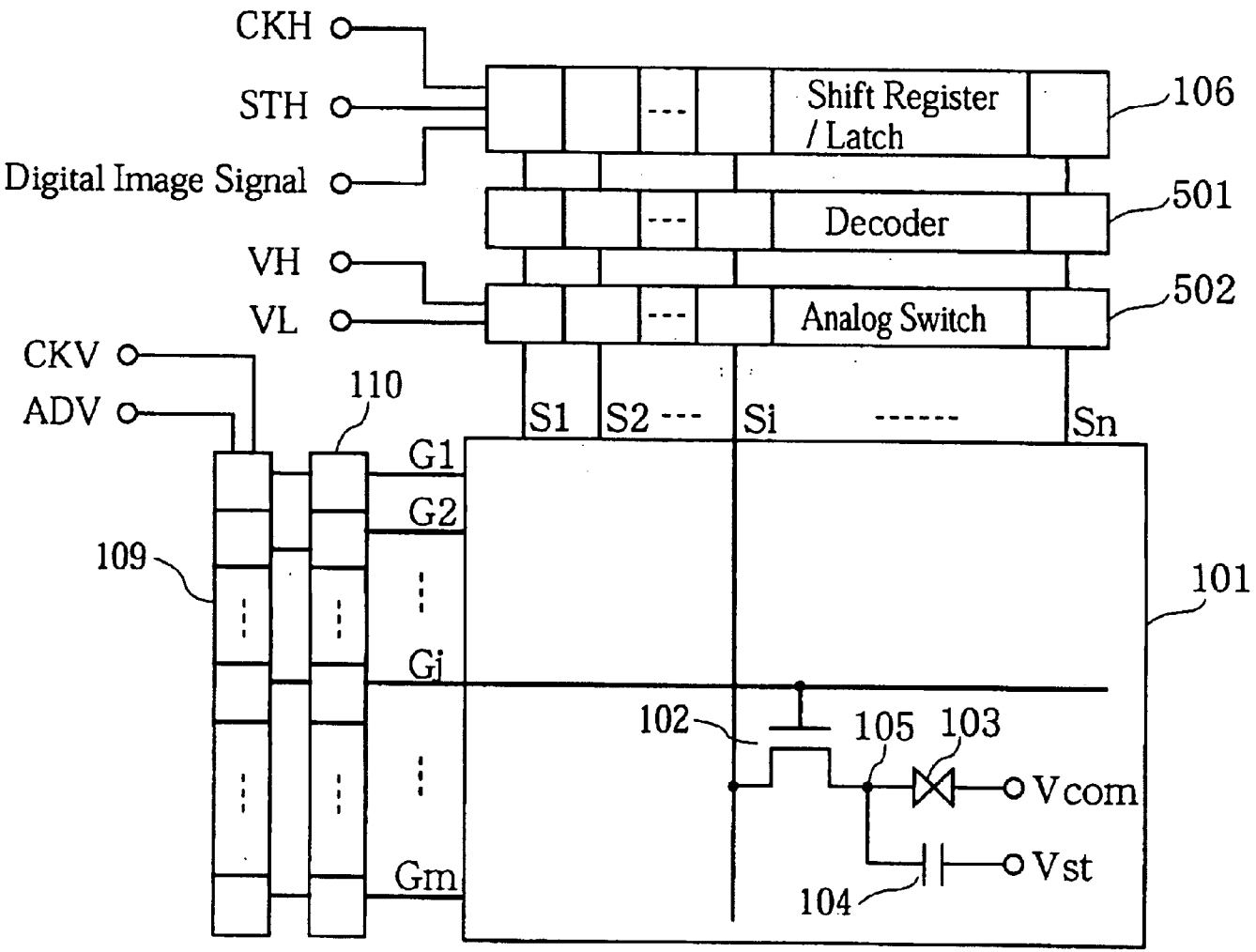
FIG. 14 is a diagram showing the construction of a digital gray scale display in a prior art active matrix liquid crystal panel.

In addition, as is shown in FIG. 9, when there are three values of fixed voltages, four sub-frames, and a hold time ratio of 1:2:2:2, by appropriately selecting the gray scale so that sudden bit changes at two adjacent gray scales are reduced, image quality degradation caused by dynamic contouring can be suppressed without increasing the number of sub-frames.

It is to be noted that in such cases using multiple-values also, in the same manner as cases where the number of values is two, alternative current driving of the liquid crystal display device without doubling the number of values of fixed voltages is possible by employing counter-inversion driving and capacitively coupled driving.

Supplementary Remarks

Although in embodiments 1 and 2, liquid crystal was used as the display element in the explanation, the same method of selecting scan lines as was described in embodiments 1 and 2 may be applied when organic EL device is used as the display element.

INDUSTRIAL APPLICABILITY

The constructions of the present invention as described above make it possible to sufficiently overcome each of the problems confronting the present invention. A specific explanation is a follows.

(1) In comparison with prior art digital gray scale display methods, there is the advantageous effect of being able to shorten the frame period and to significantly reduce flicker in prior art active matrix display devices, particularly in active matrix display devices using liquid crystal and organic EL. In addition, by fixing the frame frequency, there is the advantageous effect of being able to lengthen the horizontal scanning period and to reduce the power required for the charging and discharging of the liquid crystal panel capacity carried out at this time.

(2) There is the advantageous effect of being able to simplify the construction of a driver circuit without necessitating D/A converter circuits or operational amplifiers and to thus realize a reduction in power consumption.

(3) There is the advantageous effect of being able to reduce image quality degradation such as unevenness in brightness caused by variances in transistor characteristics without necessitating highly accurate, uniform thin film transistor characteristics to the extent called for by prior art analog gray scale display methods.

(4) By using multiple values of fixed voltages, it is made possible to improve gray scale capability and to prevent image quality degradation such as dynamic contouring without increasing power.

What is claimed is:

1. A method of driving an active matrix display device wherein one image frame comprises a plurality of sub-frames each having a sub-frame period comprising a write time and a hold time, and a gray scale image is displayed on the device by the cumulative effects of the hold times, the method comprising:

simultaneously with outputting a signal via each of signal lines, the value of the level of the signal being selected from values of a plurality of signal levels in accordance with digital image data, the number of signal levels being fewer than the number of gray scales, randomly scanning scan lines, other than one predetermined scan line, in a predetermined sequence during the hold time of each of the sub-frames corresponding to the one predetermined scan line so that any one sub-frame is not written to any one scan line more than once;

wherein one image frame period is such that in each scan line, the writing of each of the plurality of sub-frames occurs and the hold time of each of sub-frames of said one image frame period is sufficiently long enough to permit gray scale display driving.

2. A method of driving an active matrix display device according to claim 1, wherein the number of the values of the plurality of signal levels is two.

3. A method of driving an active matrix display device according to claim 1, wherein the number of the values of the plurality of signal levels is at least three.

4. A method of driving an active matrix display device wherein one image frame having a frame period comprises a plurality of sub-frames each comprising a write time and a hold time, and a gray scale image is displayed on the device by the cumulative effects of the hold times, the method comprising:

simultaneously with outputting a signal via each of signal lines, the value of the level of the signal being selected from values of a plurality of signal levels in accordance with digital image data, the number of signal levels being fewer than the number of gray scales, driving the display device such that the period of the frame is set to $$NH[1+K(2^N-1)]=NHL$$

where N is the number of sub-frames, H is a horizontal scanning period, 1:2:4: . . . :$2^{N-1}$ is the weightings of the hold times, L is the number of scan lines, and K is a positive integer.

5. A method of driving an active matrix display device according to claim 4, wherein the number of the values of the plurality of signal levels is two.

6. A method of driving an active matrix display device according to claim 4, wherein the number of the values of the plurality of signal levels is at least three.

7. A method of driving an active matrix display device wherein one image frame having a frame period comprises a plurality of sub-frames each comprising a write time and a hold time, and a gray scale image is displayed on the device by the cumulative effect of the hold times, the method comprising:

simultaneously with outputting a signal via each of signal lines, the value of the level of the signal being selected from values of a plurality of signal levels in accordance with digital image data, the number of signal levels being fewer than the number of gray scales, driving the display device such that the period of the frame is set to $$NH[1-\Sigma K(i)]=NHL$$

where N is the number of sub-frames, H is a horizontal scanning period, K(i) is the weighting of the hold time of the period of an ith sub-frame where i=1, 2, . . . , N, and L is the number of scan lines.

8. A method of driving an active matrix display device according to claim 7, wherein the number of the values of the plurality of signal levels is two.

9. A method of driving an active matrix display device according to claim 7, wherein the number of the values of the plurality of signal levels is at least three.

10. A method of driving an active matrix display device wherein one image frame having a frame period comprises a plurality of sub-frames each comprising a write time and a hold time, and a gray scale image is displayed on the device by the cumulative effects of the hold times, the method comprising: simultaneously with outputting a signal via each of signal lines, the value of the level of the signal level being selected from values of a plurality of signal levels in accordance with digital image data, and number of signal levels being at least three and fewer than the number of gray scales, bringing the degree of freedom of the signal levels usable for one gray scale within the period of the one frame to two.

11. An active matrix display device including a first substrate and a second substrate confronting the first substrate with a liquid crystal layer therebetween, the first substrate having formed thereon switching elements corresponding to the intersection points of a plurality of signal lines and a plurality of scan lines arranged in a matrix, pixel electrodes connected to the switching elements, and storage capacitors connected to the pixel electrodes and the second substrate having formed thereon a counter electrode, wherein one image frame comprises a plurality of sub-frames each having a sub-frame period comprising a write time and a hold time, and a gray scale, is displayed on the device by the cumulative effects of the hold times, the display device comprising:

a signal line driver circuit for selecting a value of a voltage level from values of a plurality of voltage levels in accordance with digital image data and outputting a voltage having the selected value via each of the signal lines, the number of the plurality of voltage levels being fewer than the number of display gray scales; and a scan line driver circuit for randomly scanning the plurality of scan lines by scanning scan lines, other than one predetermined scan line, in a predetermined sequence during the hold time of each of the sub-frames corresponding to the one predetermined scan so that any one sub-frame is not written to any one scan line more than once;

wherein one image frame period is such that in each respective scan line, the writing of each of the plurality of sub-frames occurs and the hold time of each of sub-frames of said one image frame period is sufficiently long enough to permit gray scale display driving.

12. An active matrix display device according to claim 11, wherein the number of the values of the plurality of voltage levels is two.

13. An active matrix display device according to claim 11, wherein the number of the values of the plurality of voltage levels is at least three.

14. An active matrix display device according to claim 11, wherein the signal line driver circuit comprises an analog multiplexer for selecting one value of a voltage level selected from the plurality of voltage levels and outputting a voltage having the selected one value.

15. An active matrix display device according to claim 11, wherein the scan line driver circuit comprises a decoder for selecting the scan lines in accordance with inputted address signals.

16. An active matrix display device according to claim 11, wherein each of the switching elements comprises a three-terminal thin film transistor.

17. An active matrix display device according to claim 11, wherein the counter electrode is for being driven by inversion driving according to a cycle of an integral multiple of a horizontal scanning period, the driving being synchronized with output signals from the signal line driver circuit.

18. An active matrix display device according to claim 11, further comprising a driver for selecting outputs supplied from the scan line driver circuit from four values to carry out capacitively coupled driving.

19. An active matrix display device according to claim 11, further comprising a driver for selecting outputs supplied from the scan line driver circuit from two values and the storage capacitors are independently driven with two values to carry out capacitively coupled driving.

20. An active matrix display device including a first substrate and a second substrate confronting the first substrate with a liquid crystal layer therebetween, the first substrate having formed thereon switching elements corresponding to the intersection points of a plurality of signal lines and a plurality of scan lines arranged in a matrix, pixel electrodes connected to the switching elements, and storage capacitors connected to the pixel electrodes and the second substrate having formed thereon a counter electrode, wherein one image frame comprises a plurality of sub-frames each comprising a write time and a hold time, and a gray scale, is displayed on the device by the cumulative effects of the hold times, the display device comprising:

a signal line driver circuit for selecting a value of a voltage level from values of a plurality of voltage levels in accordance with digital image data and outputting a voltage having the selected value via each of the signal lines, the number of the plurality of voltage levels being fewer than the number of display gray scales; and a scan line driver circuit for selecting the scan lines so that the period of the frame is $$NH[1+K(2^N-1)]=NHL$$

where N is the number of sub-frames, H is a horizontal scanning period, 1:2:4: . . . :$2^{N-1}$ is the weightings of the hold times, L is the number of scan lines, and K is a positive integer.

21. An active matrix display device according to claim 20, wherein the number of the values of the plurality of voltage levels is two.

22. An active matrix display device according to claim 20, wherein the number of the values of the plurality of voltage levels is at least three.

23. An active matrix display device according to claim 20, wherein the signal line driver circuit comprises an analog multiplexer for selecting one value of a voltage level selected from the plurality of voltage levels and outputting a voltage having the selected one value.

24. An active matrix display device according to claim 20, wherein the scan line driver circuit comprises a decoder for selecting the scan lines in accordance with inputted address signals.

25. An active matrix display device according to claim 20, wherein each of the switching elements comprises a three-terminal thin film transistor.

26. An active matrix display device according to claim 20, wherein the counter electrode is for being driven by inversion driving according to a cycle of an integral multiple of a horizontal scanning period, the driving being synchronized with output signals from the signal line driver circuit.

27. An active matrix display device according to claim 20, further comprising a driver for selecting outputs supplied from the scan line driver circuit from four values to carry out capacitively coupled driving.

28. An active matrix display device according to claim 20, further comprising a driver for selecting outputs supplied from the scan line driver circuit from two values and the storage capacitors are independently driven with two values to carry out capacitively coupled driving.

29. An active matrix display device including a first substrate and a second substrate confronting the first substrate with a liquid crystal layer therebetween, the first substrate having formed thereon switching elements corresponding to the intersection points of a plurality of signal lines and a plurality of scan lines arranged in a matrix, pixel electrodes connected to the switching elements, and storage capacitors connected to the pixel electrodes and the second substrate having formed thereon a counter electrode, wherein one image frame comprises a plurality of sub-frames each having a sub-frame period comprising a write time and a hold time, and a gray scale, is displayed on the device by the cumulative effects of the hold times, the display device comprising:

a signal line driver circuit for selecting a value of a voltage level from values of a plurality of voltage levels in accordance with digital image data and outputting a voltage having the selected value via each of the signal lines, the number of the plurality of voltage levels being fewer than the number of display gray scales; and a scan line driver circuit for selecting the scan lines so that the period of the frame is $$NH[1-\Sigma K(i)]=NHL$$

where N is the number of sub-frames, H is a horizontal scanning period, K(i) is the weighting of the hold time of the period of an ith sub-frame where i=1, 2, . . . , N, and L is the number of scan lines.

30. An active matrix display device according to claim 29, wherein the number of the values of the plurality of voltage levels is two.

31. An active matrix display device according to claim 29, wherein the number of the values of the plurality of voltage levels is at least three.

32. An active matrix display device according to claim 29, wherein the signal line driver circuit comprises an analog multiplexer for selecting one value of a voltage level selected from the plurality of voltage levels and outputting a voltage having the selected one value.

33. An active matrix display device according to claim 29, wherein the scan line driver circuit comprises a decoder for selecting the scan lines in accordance with inputted address signals.

34. An active matrix display device according to claim 29, wherein each of the switching elements comprises a three-terminal thin film transistor.

35. An active matrix display device according to claim 29, wherein the counter electrode is for being driven by inversion driving according to a cycle of an integral multiple of a horizontal scanning period, the driving being synchronized with output signals from the signal line driver circuit.

36. An active matrix display device according to claim 29, further comprising a driver for selecting outputs supplied from the scan line driver circuit from four values to carry out capacitively coupled driving.

37. An active matrix display device according to claim 29, further comprising a driver for selecting outputs supplied from the scan line driver circuit from two values and the storage capacitors are independently driven with two values to carry out capacitively coupled driving.

38. An active matrix display device including a first substrate and a second substrate confronting the first substrate with a liquid crystal layer therebetween, the first substrate having formed thereon switching elements corresponding to the intersection points of a plurality of signal lines and a plurality of scan lines arranged in a matrix, pixel electrodes connected to the switching elements, and storage capacitors connected to the pixel electrodes and the second substrate having formed thereon a counter electrode, wherein one image frame comprises a plurality of sub-frames each comprising a write time and a hold time, and a gray scale, is displayed on the device by the cumulative effect of the hold times, the display device comprising:

a signal line driver circuit for selecting a value of a voltage level from values of a plurality of voltage levels in accordance with digital image data and outputting a voltage having the selected value via each of the signal lines, the number of the plurality of voltage levels being at least three and fewer than the number of display gray scales and the selection being carried out so that the degree of freedom of the voltage levels usable for one gray scale within the period of the one frame is two; and a scan line driver circuit for sequentially scanning or randomly scanning the scan lines.

39. An active matrix display device according to claim 38, wherein the signal line driver circuit comprises an analog multiplexer for selecting one value of a voltage level selected from the plurality of voltage levels and outputting a voltage having the selected one value.

40. An active matrix display device according to claim 38, wherein the scan line driver circuit comprises a decoder for selecting the scan lines in accordance with inputted address signals.

41. An active matrix display device according to claim 38, wherein each of the switching elements comprises a three-terminal thin film transistor.

42. An active matrix display device according to claim 38, wherein the counter electrode is for being driven by inversion driving according to a cycle of an integral multiple of a horizontal scanning period, the driving being synchronized with output signals from the signal line driver circuit.

43. An active matrix display device according to claim 38, further comprising a driver for selecting outputs supplied from the scan line driver circuit from four values to carry out capacitively coupled driving.

44. An active matrix display device according to claim 38, further comprising a driver for selecting outputs supplied from the scan line driver circuit from two values and the storage capacitors are independently driven with two values to carry out capacitively coupled driving.

45. An active matrix display device including a first substrate and a second substrate confronting the first substrate with a luminescent layer therebetween, the first substrate having formed thereon first switching elements corresponding to the intersection points of a plurality of signal lines and a plurality of scan lines arranged in a matrix, second switching elements connected to the first switching elements, pixel electrodes connected to the second switching elements, and power supply lines connected to a side of the second switching elements differing from that to which the pixel electrodes are connected and the second substrate having formed thereon a counter electrode, wherein one image frame comprises a plurality of sub-frames each having a sub-frame period comprising a write time and a hold time, and a gray scale, is displayed on the device by the cumulative effects of the hold times, the display device comprising:

a signal line driver circuit for selecting a value of a voltage level from values of a plurality of voltage levels in accordance with digital image data and outputting a voltage having the selected value via each of the signal lines, the number of the plurality of voltage levels being fewer than the number of display gray scales; and a scan line driver circuit for randomly scanning the plurality of scan lines by scanning scan lines, other than one predetermined scan line, in a predetermined sequence during the hold time of each of the sub-frames corresponding to the one predetermined scan so that any one sub-frame is not written to any one scan line more than once;

wherein one image frame period is such that in each respective scan line, the writing of each of the plurality of sub-frames occurs and the hold time of each of sub-frames of said one range frame period is sufficiently long enough to permit gray scale display driving.

46. An active matrix display device according to claim 45, wherein the number of the values of the plurality of voltage levels is two.

47. An active matrix display device according to claim 45, wherein the number of the values of the plurality of voltage levels is at least three.

48. An active matrix display device according to claim 45, wherein the signal line driver circuit comprises an analog multiplexer for selecting one value of a voltage level selected from the plurality of voltage levels and outputting a voltage having the selected one value.

49. An active matrix display device according to claim 45, wherein the scan line driver circuit comprises a decoder for selecting the scan lines in accordance with inputted address signals.

50. An active matrix display device according to claim 45, wherein each of the first switching elements and the second switching elements comprises a three-terminal thin film transistor.

51. An active matrix display device including a first substrate and a second substrate confronting the first substrate with a luminescent layer therebetween, the first substrate having formed thereon first switching elements corresponding to the intersection points of a plurality of signal lines and a plurality of scan lines arranged in a matrix, second switching elements connected to the first switching elements, pixel electrodes connected to the second switching elements, and power supply lines connected to a side of the second switching elements differing from that to which the pixel electrodes are connected and the second substrate having formed thereon a counter electrode, wherein one image frame comprises a plurality of sub-frames each comprising a write time and a hold time, and a gray scale, is displayed on the device by the cumulative effects of the hold times, the display device comprising:

a signal line driver circuit for selecting a value of a voltage level from values of a plurality of voltage levels in accordance with digital image data and outputting a voltage having the selected value via each of the signal lines, the number of the plurality of voltage levels being fewer than the number of display gray scales; and a scan line driver circuit for selecting the scan lines so that the period of the frame is $$NH[1+K(2^N-1)]=NHL$$

where N is the number of sub-frames, H is a horizontal scanning period, 1:2:4: . . . :$2^{N-1}$ is the weightings of the hold times, L is the number of scan lines, and K is a positive integer.

52. An active matrix display device according to claim 51, wherein the number of the values of the plurality of voltage levels is two.

53. An active matrix display device according to claim 51, wherein the number of the values of the plurality of voltage levels is at least three.

54. An active matrix display device according to claim 51, wherein the signal line driver circuit comprises an analog multiplexer for selecting one value of a voltage level selected from the plurality of voltage levels and outputting a voltage having the selected one value.

55. An active matrix display device according to claim 51, wherein the scan line driver circuit comprises a decoder for selecting the scan lines in accordance with inputted address signals.

56. An active matrix display device according to claim 51, wherein each of the first switching elements and the second switching elements comprises a three-terminal thin film transistor.

57. An active matrix display device including a first substrate and a second substrate confronting the first substrate with a luminescent layer therebetween, the first substrate having formed thereon first switching elements corresponding to the intersection points of a plurality of signal lines and a plurality of scan lines arranged in a matrix, second switching elements connected to the first switching elements, pixel electrodes connected to the second switching elements, and power supply lines connected to a side of the second switching elements differing from that to which the pixel electrodes are connected and the second substrate having formed thereon a counter electrode, wherein one image frame comprises a plurality of sub-frames each comprising a write time and a hold time, and a gray scale, is displayed on the device by the cumulative effects of the hold times, the display device comprising:

a signal line driver circuit for selecting a value of a voltage level from values of a plurality of voltage levels in accordance with digital image data and outputting a voltage having the selected value via each of the signal lines, the number of the plurality of voltage levels being fewer than the number of display gray scales; and a scan line driver circuit for selecting the scan lines so that the period of the frame is $$NH[1-\Sigma K(i)]=NHL$$

where N is the number of sub-frames, H is a horizontal scanning period, K(i) is the weighting of the hold time of the period of an ith sub-frame where i=1, 2, . . . , N, and L is the number of scan lines.

58. An active matrix display device according to claim 57, wherein the number of the values of the plurality of voltage levels is two.

59. An active matrix display device according to claim 57, wherein the number of the values of the plurality of voltage levels is at least three.

60. An active matrix display device according to claim 57, wherein the signal line driver circuit comprises an analog multiplexer for selecting one value of a voltage level selected from the plurality of voltage levels and outputting a voltage having the selected one value.

61. An active matrix display device according to claim 57, wherein the scan line driver circuit comprises a decoder for selecting the scan lines in accordance with inputted address signals.

62. An active matrix display device according to claim 57, wherein each of the first switching elements and the second switching elements comprises a three-terminal thin film transistor.

63. An active matrix display device including a first substrate and a second substrate confronting the first substrate with a luminescent layer therebetween, the first substrate having formed thereon first switching elements corresponding to the intersection points of a plurality of signal lines and a plurality of scan lines arranged in a matrix, second switching elements connected to the first switching elements, pixel electrodes connected to the second switching elements, and power supply lines connected to a side of the second switching elements differing from that to which the pixel electrodes are connected and the second substrate having formed thereon a counter electrode, wherein one image frame comprises a plurality of sub-frames each comprising a write time and a hold time, and a gray scale, is displayed on the device by the cumulative effect of the hold times, the display device comprising:

a signal line driver circuit for selecting a value of a voltage level from values of a plurality of voltage levels in accordance with digital image data and outputting a voltage having the selected value via each of the signal lines, the number of the plurality of voltage levels being at least three and fewer than the number of display gray scales and the selection being carried out so that the degree of freedom of the voltage levels usable for one gray scale within the period of the one frame is two; and a scan line driver circuit for sequentially scanning or randomly scanning the scan lines.

64. An active matrix display device according to claim 63, wherein the signal line driver circuit comprises an analog multiplexer for selecting one value of a voltage level selected from the plurality of voltage levels and outputting a voltage having the selected one value.

65. An active matrix display device according to claim 63, wherein the scan line driver circuit comprises a decoder for selecting the scan lines in accordance with inputted address signals.

66. An active matrix display device according to claim 63, wherein each of the first switching elements and the second switching elements comprises a three-terminal thin film transistor.

* * * * *

UNITED STATES PATENT AND TRADEMARK OFFICE

CERTIFICATE OF CORRECTION

PATENT NO. : 6,924,824 B2
APPLICATION NO. : 09/936172
DATED : August 2, 2005
INVENTOR(S) : Adachi et al.

It is certified that error appears in the above-identified patent and that said Letters Patent is hereby corrected as shown below:

The title page Item (56) col 2
In the references:
Insert a new section --OTHER DOCUMENTS--, with the following reference:
--Mano, H. et al. "TFT-LCD Drive Method and Driver LSI"; Hitachi Review, Hitachi Ltd., Tokyo, JP, Vol. 45, No. 4, August 1, 1996; pp. 177-182--.
In the claims:
column 18, line 8, delete the equation "NH[1-ΣK(i)]=NHL" and replace with --NH[1+ΣK(i)]=NHL--,
column 21, line 20, delete the equation "NH[1-ΣK(i)]=NHL" and replace with --NH[1+ΣK(i)]=NHL--.

Signed and Sealed this

Eighth Day of August, 2006

JON W. DUDAS
*Director of the United States Patent and Trademark Office*